US007970334B2

(12) United States Patent
Yamashita et al.

(10) Patent No.: US 7,970,334 B2
(45) Date of Patent: Jun. 28, 2011

(54) IMAGE-CARRIER PROTECTING AGENT, PROTECTING-LAYER FORMING DEVICE, IMAGE FORMING METHOD, IMAGE FORMING APPARATUS, AND PROCESS CARTRIDGE

(75) Inventors: Masahide Yamashita, Tokyo (JP); Hiroshi Nakai, Kanagawa (JP); Masato Iio, Kanagawa (JP); Shinya Tanaka, Kanagawa (JP); Naoyuki Ozaki, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 848 days.

(21) Appl. No.: 11/952,453

(22) Filed: Dec. 7, 2007

(65) Prior Publication Data

US 2008/0138132 A1 Jun. 12, 2008

(30) Foreign Application Priority Data

Dec. 11, 2006 (JP) ..... 2006-333583

(51) Int. Cl.
*G03G 21/00* (2006.01)

(52) U.S. Cl. ..... 399/346

(58) Field of Classification Search ..... 399/346; 430/126.2

See application file for complete search history.

(56) References Cited

U.S. PATENT DOCUMENTS

| | | | | |
|---|---|---|---|---|
| 5,812,919 | A * | 9/1998 | Takano et al. | 399/312 |
| 6,295,438 | B1 * | 9/2001 | Fujishiro et al. | 399/346 |
| 6,330,420 | B1 * | 12/2001 | Honda | 399/346 |
| 7,035,582 | B2 | 4/2006 | Suda et al. | |
| 7,103,301 | B2 | 9/2006 | Watanabe et al. | |
| 7,218,879 | B2 | 5/2007 | Enoki et al. | |
| 7,251,438 | B2 | 7/2007 | Watanabe et al. | |
| 7,653,339 | B2 * | 1/2010 | Yamashita et al. | 399/346 |
| 2005/0152722 | A1 * | 7/2005 | Tawada et al. | 399/346 |
| 2005/0276632 | A1 | 12/2005 | Ariizumi et al. | |
| 2007/0242992 | A1 | 10/2007 | Watanabe et al. | |
| 2007/0258723 | A1 | 11/2007 | Nakazato et al. | |

FOREIGN PATENT DOCUMENTS

| | | |
|---|---|---|
| CN | 1573620 A | 2/2005 |
| JP | 51-22380 | 2/1976 |
| JP | 2000-98838 | 4/2000 |
| JP | 2000-330441 | 11/2000 |
| JP | 2002-97483 | 4/2002 |
| JP | 2004-302451 | 10/2004 |
| JP | 2005-99125 | 4/2005 |
| JP | 2005-274737 | 10/2005 |

* cited by examiner

*Primary Examiner* — David P Porta
*Assistant Examiner* — Bryan P Ready
(74) *Attorney, Agent, or Firm* — Oblon, Spivak, McClelland, Maier & Neustadt, L.L.P.

(57) ABSTRACT

A protecting layer is formed on a surface of an image carrier with a protecting agent that contains at least an organic compound having melting property of which penetration at 25° C. ranges from 3 millimeters to 30 millimeters, and organic compound particles having thermal decomposition property of which a weight average particle size ranges from 2 micrometers to 20 micrometers. A melting temperature of the organic compound is lower than a decomposition temperature of the organic compound particles, and a volume ratio of the organic compound to the organic compound particles ranges from 99/1 to 50/50.

17 Claims, 3 Drawing Sheets

IMAGE-CARRIER PROTECTING AGENT, PROTECTING-LAYER FORMING DEVICE, IMAGE FORMING METHOD, IMAGE FORMING APPARATUS, AND PROCESS CARTRIDGE

CROSS-REFERENCE TO RELATED APPLICATIONS

The present application claims priority to and incorporates by reference the entire contents of Japanese priority document 2006-333583 filed in Japan on Dec. 11, 2006.

BACKGROUND OF THE INVENTION

1. Field of the Invention

The present invention relates to a technology for protecting the surface of an image carrier used to form an electrophotographic image by using a protecting agent for the image carrier.

2. Description of the Related Art

Conventionally, image formation based on an electrophotographic system is implemented by forming an electrostatic latent image on an image carrier that has a photoconductive layer containing a photoconductive material or the like, and attracting charged toner to the electrostatic latent image to form a visible image. The visible image is transferred to a recording medium such as a sheet of paper and is fixed on the recording medium by heat, pressure, or solvent gas, and an output image is thereby obtained.

The image formation is roughly classified into a two-component developing method of using frictional charging due to stirring and mixing of toner and carrier, and a one-component developing method of charging toner without using carrier, depending on how to charge toner to obtain a visible image. The one-component developing method is further classified into a magnetic one-component developing method and a nonmagnetic one-component developing method depending on whether a magnetic force is used to hold the toner on a developing roller.

The two-component developing method is commonly used for copiers that require high speed capability and image reproduction or for multifunction products based on the copier because of requirements such as charging stability of toner, rising capability, long-term stability of the image quality. On the other hand, the one-component developing method is commonly used for compact type printers and facsimiles that require space saving and low cost.

Recently, colorization of output images is widely spread, and therefore, in both of the developing methods, requirements for higher quality of images and stability of image quality are increasing more and more. To achieve the higher quality of images, an average particle size of toner is made smaller and an angular portion of its particle shape is made smoother, so that toner is becoming more spherical.

In general, irrespective of different developing methods, an electrophotographic image forming apparatus uniformly charges a drum-shaped or a belt-shaped image carrier while being made to rotate, forms a latent image pattern on the image carrier by using laser light or the like, visualizes the latent image pattern with toner (toner image), and transfers the toner image to the recording medium. After the toner image is transferred to the recording medium, toner components not having been transferred remain on the image carrier. If these residues are conveyed to a charging process without being removed, these residues prevent uniform charging on the image carrier. Therefore, after the transfer process, the toner or the like remaining on the image carrier is generally removed by a cleaning unit such as a cleaning blade, to make the surface of the image carrier be sufficiently clean, and thereafter the image carrier is charged.

The surface of the image carrier is physically stressed and electrically stressed in various manners during each process of charging, development, transfer, and cleaning, and the state of the surface changes in association with used hours. The stress due to friction in the cleaning process of these stresses causes the image carrier to wear and to be scratched. To resolve these problems, many solutions have been proposed such as various types of lubricants, supply of a lubricating component, and a method of forming a lubricant layer.

To extend life of a photoconductor and a cleaning blade, Japanese Patent Application Laid-Open No. S51-22380 (Patent document 1) proposes a technology for supplying a solid lubricant that contains zinc stearate as a main component to the surface of a photoconductor to form lubricant coating thereon.

Japanese Patent Application Laid-Open No. 2005-274737 (Patent document 2) describes that by using a lubricant applying device that applies a lubricant containing higher alcohol having a carbon number of 20 to 70, the higher alcohol stays as amorphous particles at an edge of a blade nip and this causes the surface of an image carrier to become appropriately wet, and thus lubricating capability is continued.

Japanese Patent Application Laid-Open No. 2002-97483 (Patent document 3) describes that by using particular powder of alkylene bis-alkyl acid amide compound as a lubricating component, there exists the powder on an interface between a cleaning blade and the surface of an image carrier, which allows smooth lubricating effect to be maintained over a long period of time.

However, as explained above, the stress on the image carrier is derived not only from the cleaning process but also includes electrical stress particularly in the charging process that largely changes the state of the surface of the image carrier. The electrical stress is accompanied with an electrical discharge phenomenon near the surface of the image carrier, and this phenomenon is significant in a contact charging system and a proximity charging system. In these charging systems, many active species and reaction products are produced on the surface of the image carrier, and the active species and the reaction products produced in the air of a discharging area are commonly attracted to the surface of the image carrier.

Therefore, the lubricant using the zinc stearate as described in Patent document 1 comparatively evenly covers the surface of the image carrier to give an appropriate lubricating property thereto. However, if a lubricant layer produced thereby repeatedly passes through the charging process, the stearic acid is decomposed and may eventually remain as zinc oxide on the surface of the image carrier and the surface of a charging unit. The remaining zinc oxide has moisture absorption characteristics, and the resistance reduces caused by moisture absorption in the air. Therefore, electrostatic charge on the image carrier cannot be retained under high humidity environment, and an electrostatic latent image becomes vague, which may cause image failure so-called image blur to occur.

The lubricant based on the higher alcohol described in Patent document 2 is easy to wet the surface of the image carrier and the effect as the lubricant can be expected. However, an area occupied by each of higher alcohol molecules absorbed in the image carrier tends to increase, and the density of molecules absorbed in the image carrier per unit area (weight of absorbed molecules per unit area) is low. Consequently, the electrical stress easily penetrates a protecting layer, and thus the effect to satisfactorily protect the image carrier cannot easily be obtained.

As described in Patent document 3, the lubricant containing nitrogen atoms in molecules produces an ionic dissociating compound as a decomposed product like a nitrogen oxide and an ammonium-containing compound when the lubricant itself is exposed to the electrical stress. And the ionic dissociating compound is taken into the lubricant layer and the resistance of the lubricant layer is reduced under high humidity, which may cause image blur to occur.

Long-life image forming apparatuses and long-life components for use in the image forming apparatuses have the great interest at the market in terms of reduction of running costs and protection of global environment due to reduction of waste. For example, to achieve a long-life image carrier, Japanese Patent Application Laid-Open No. 2004-302451 (Patent document 4) discloses a trial in such a manner that a specific surface layer having a cross-linked structure is provided on the surface of the image carrier to improve mechanical durability.

However, as explained above, if a low-resistance substance is taken into the lubricant layer of the image carrier and if the low-resistance substance is removed thereafter, it will be necessary to scrape the whole lubricant layer by, for example, a cleaning mechanism. However, because the lubricant layer itself is slippery, not only the large force is needed for its removal but also the large mechanical stress is applied to the image carrier upon the removal. Therefore, even if the specific surface layer having the cross-linked structure is provided on the surface of the image carrier as described in Patent document 4, the provision of the surface layer does not lead to the long-life image carrier.

Recently, polymerized toner particles manufactured by using a polymerization method are regarded as important to improve image quality and reduce manufacturing energy. The polymerized toner has excellent features such that the polymerized toner particles have angular portions less than these of pulverized toner particles manufactured by a pulverization method, and have a small average particle size and the particles are uniform. However, in the method of pressing an edge of a cleaning unit such as a rubber-made cleaning blade against the surface of the image carrier to clean the surface thereof, it becomes difficult to block the toner particles by the edge due to the shape and the particle size of the polymerized toner particles, which easily causes cleaning failure to occur, namely, residual toner components cannot satisfactorily be cleaned.

Japanese Patent Application Laid-Open No. 2000-330441 (Patent document 5) proposes an image forming apparatus in which a cleaning device capable of improving cleaning failure of such toner as explained above sets a pressing force to satisfy predetermined conditions using a volume-average particle size D and average circularity S of the toner. It is described in this proposal that if a pressing force f is increased when a counter-type cleaning blade is used, some trouble such as squeaking of the cleaning blade and a warp thereof occurs, and it is therefore necessary to set an upper limit as an experimental value.

Furthermore, Japanese Patent Application Laid-Open No. 2005-99125 (Patent document 6) proposes a cleaning device in which a frictional coefficient between toner and an image carrier, a frictional coefficient between toner and a blade, an adhesion force between the toner and the image carrier, a force by the blade against the toner, and an angle (cleaning angle) formed between the blade and the image carrier are respectively defined to clean the toner having a smaller average particle size and a shape closer to a sphericity.

Patent documents 5 and 6 propose the devices to improve the cleaning capability of spherical toner represented by the polymerized toner while reducing the stress on the image carrier in the cleaning mechanism, but there is neither disclosure nor suggestive hint about longer operating life in consideration of the electrical stress on the image carrier. Thus, it does not seem to improve the capability.

Therefore, even though the protection of the surface of the image carrier from the electrical stress in the charging process is extremely important to the longer operating life of the image carrier and the charging unit and to the stabilized image quality, appropriate studies on this matter have not been conducted until now, and at the present situation, this matter therefore still remains as an unsolved problem.

SUMMARY OF THE INVENTION

It is an object of the present invention to at least partially solve the problems in the conventional technology.

A protecting agent for an image carrier, according to one aspect of the present invention contains at least an organic compound having melting property of which penetration at 25° C. is in a range from 3 millimeters to 30 millimeters and an organic compound particle having thermal decomposition property of which a weight average particle size is in a range from 2 micrometers to 20 micrometers. A melting temperature of the organic compound is lower than a decomposition temperature of the organic compound particle. A volume ratio of the organic compound to the organic compound particle is in a range from 99/1 to 50/50.

A protecting-layer forming device according to another aspect of the present invention includes a protecting agent for an image carrier, the protecting agent containing at least an organic compound having melting property of which penetration at 25° C. is in a range from 3 millimeters to 30 millimeters and an organic compound particle having thermal decomposition property of which a weight average particle size is in a range from 2 micrometers to 20 micrometers; a holding unit for holding the protecting agent; a protecting-agent supplying unit that supplies the protecting agent to the image carrier; and a pressing-force applying unit that presses the protecting agent against the protecting-agent supplying unit to make the protecting agent in contact with the protecting-agent supplying unit. A melting temperature of the organic compound is lower than a decomposition temperature of the organic compound particle. A volume ratio of the organic compound to the organic compound particle is in a range from 99/1 to 50/50.

An image forming apparatus according to still another aspect of the present invention includes an image carrier on which an electrostatic latent image is formed; an electrostatic-latent-image forming unit that forms the electrostatic latent image on the image carrier; a developing unit that develops the electrostatic latent image using a toner to form a visible image; a transfer unit that transfers the visible image onto a recording medium; a protecting-layer forming device including a protecting agent for an image carrier, the protecting agent containing at least an organic compound having melting property of which penetration at 25° C. is in a range from 3 millimeters to 30 millimeters and an organic compound particle having thermal decomposition property of which a weight average particle size is in a range from 2 micrometers to 20 micrometers, a holding unit for holding the protecting agent, a protecting-agent supplying unit that supplies the protecting agent to the image carrier, and a pressing-force applying unit that presses the protecting agent against the protecting-agent supplying unit to make the protecting agent in contact with the protecting-agent supplying unit; and a fixing unit that fixes the visible image transferred onto the recording medium. A melting temperature of the organic compound is lower than a decomposition temperature of the organic compound particle. A volume ratio of the organic compound to the organic compound particle is in a range from 99/1 to 50/50.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
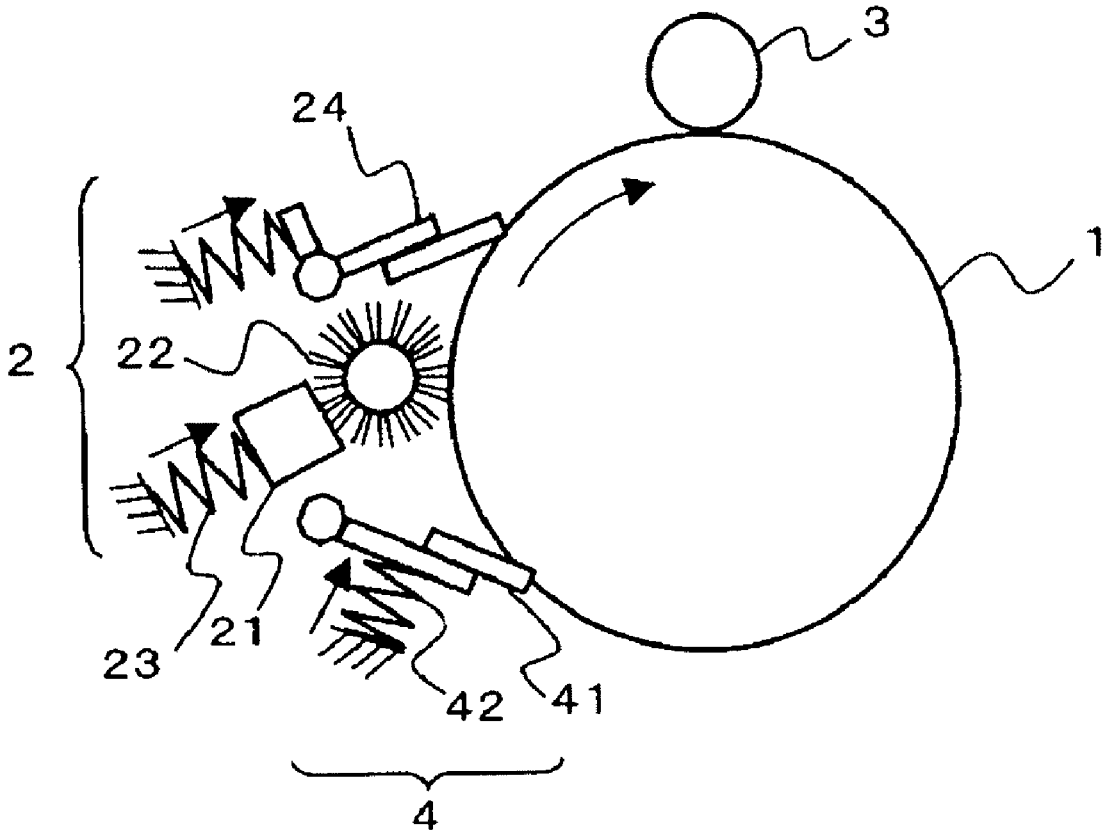
FIG. 1 is a schematic of one example of a protecting-layer forming device according to the present invention.

Exemplary embodiments of the present invention are explained in detail below with reference to the accompanying drawings.

A protecting agent for an image carrier (hereinafter, "protecting agent") according to the present invention contains an organic compound having melting property and organic compound particles having thermal decomposition property, and further contains other components if necessary.

The organic compound having melting property of which penetration at 25° C. ranges from 3 millimeters to 30 millimeters is used.

The organic compound particles having thermal decomposition property of which a weight average particle size D4 ranges from 2 micrometers to 20 micrometers is used.

Organic compound particles having thermal decomposition property of which decomposition temperature is higher than a melting temperature of the organic compound having melting property are selected. Further, these compounds are contained so that a volume ratio of the organic compound having melting property to the organic compound particles having thermal decomposition property ranges from 99/1 to 50/50.

The organic compound having melting property is not particularly limited, and therefore can be suitably selected depending on the application. However, ones having a sharp peak in melting heat and having low viscosity of melted liquid after being melted are preferred. Examples thereof are hydrocarbons classified into saturated aliphatic hydrocarbon, unsaturated aliphatic hydrocarbon, saturated alicyclic hydrocarbon, unsaturated alicyclic hydrocarbon, and aromatic hydrocarbon; natural vegetable waxes such as carnauba wax, rice bran wax, and candelilla wax; and natural animal wax such as beeswax and snow wax. These can be used singly or in combination of two or more.

The saturated aliphatic hydrocarbon and the saturated alicyclic hydrocarbon each in which intramolecular binding is formed only with saturated binding whose reactivity is low and stable are particularly preferred. Among these, normal paraffin, isoparaffin, and cycloparaffin are preferably used in terms of stability with time because addition reaction hardly occurs and thus these paraffins are chemically stable and oxidation reaction hardly occurs in the air in actual use.

Furthermore, by using hydrocarbon wax containing at least one of the isoparaffin and the cycloparaffin in particular as the organic compound having melting property, temperature dependence of the penetration decreases. Consequently, the influence of environment temperature on uniformity of the protecting layer can be reduced and the image carrier can be protected in a wide range of temperature, which is more preferable.

The protecting layer formed on the surface of the image carrier is exposed to the electrical stress and is thereby degraded in the above manner. Therefore, if the molecular weight of the organic compound having melting property is too low, protection effect may not be expressed sufficiently.

On the other hand, if the molecular weight of the organic compound having melting property is too high, the protecting agent into which the organic compound particles are dispersed may be hardened, and removal of the protecting agent in the internal interface is inhibited, which may cause improper supply of the protecting agent.

The molecular weight of the organic compound having melting property is set to a range of 350 to 850 based on a weight-average molecular weight Mw, and protection effect and supply capability can thereby be reliably expressed. Thus, the range is preferable, and a range of 400 to 800 is more preferable.

The organic compound particles having thermal decomposition property exist on the surface of the protecting agent by a certain amount so that foreign matters such as toner are prevented from their adhesion to the surface of or their burying into the inner side of the protecting agent. And by forming an interface between the organic compound particles having thermal decomposition property and the organic compound having melting property inside the protecting agent, the protecting agent is removed from the interface, to thereby prevent deposition of the foreign matters on the surface portion of the protecting agent.

By dispersing polysaccharide as the organic compound particles having thermal decomposition property, in which 5 monosaccharides to 100 monosaccharides on an average are dehydrated and condensed, into the organic compound having melting property to be used, the internal interface which is easily removed can be formed. Thus the polysaccharide is preferable.

By using thermosetting resin particles as the organic compound particles having thermal decomposition property, inter-particle aggregation and deformation of the particles do not occur when the resin particles are dispersed into the organic compound having melting property. Thus, the hardness of the protecting agent can be well controlled and consumption speed of the protecting agent can be adjusted according to the process of image formation. Thus the thermosetting resin particles are preferably used.

By using silicone rubber particles as the organic compound particles having thermal decomposition property, a large change in volume occurring when the organic compound having melting property is changed in phase from its melted state to solid is elastically absorbed upon formation of the protecting agent, so that the accuracy of the shape can be improved, and resistance properties against the mechanical stress in the protecting layer on the surface of the image carrier can further be improved. Thus the silicone rubber particles are preferably used.

When the organic compound particles having thermal decomposition property are dispersed into the organic compound having melting property, the dispersion may not always be uniform caused by the degree of hydrophilic property on the particle surfaces and a difference in specific gravity between substances, depending on selection of materials. The non-uniform dispersion causes deviation of compositions in the protecting agent, and therefore a desired property of the protecting agent cannot always be stably expressed, which is not preferred. By containing 0.1 wt % to 5 wt % of amphiphilic organic compound in the organic compound particles having thermal decomposition property, dispersion of the particles can be stabilized. If the content of the amphiphilic organic compound is less than 0.1 wt %, then the dispersion of the particles may be insufficient. Conversely, if the content exceeds 5 wt %, then the degree of affinity at the internal interface is too high, and the supply stability may decrease.

In this case, to adequately disperse the particles with appropriate affinity, a hydrophile-lipophile balance (HLB) value in the amphiphilic organic compound is important. And by setting the value to a range of 1.0 to 5.0, the dispersion can be adequately stabilized, which is preferable.

The HLB value represents the degree of affinity of a surfactant to water and oil (water-insoluble organic compound), and the higher the value, the higher the affinity to water. The HLB value of the present invention is calculated by the following formula which is so-called Kawakami's method.

$$HLB=7+11.7\log(Mw/Mo)$$

where Mw is a molecular weight of a hydrophilic portion, Mo is a molecular weight of a lipophilic group, and log is a common logarithm.

The amphiphilic organic compound (B) in the image carrier is preferably a nonionic surfactant.

The amphiphilic organic compound is classified into an anionic surfactant, a cationic surfactant, a zwitterionic surfactant, a nonionic surfactant, and a compound thereof. The protecting agent is required to prevent a bad influence from being exerted upon the electrical property of the image carrier to form the protecting agent on the image carrier and perform an imaging process.

When the nonionic surfactant is used as the amphiphilic organic compound, there is no ionic dissociation in the surfactant itself. Therefore, even if the use environment, particularly, humidity largely changes, charge leakage due to aerial discharge can be suppressed, and high image quality can be maintained.

Examples of the anionic surfactant includes compounds containing anion at the end of a hydrophobic portion such as alkylbenzene sulfonate, α-olefin sulfonate, alkane sulfonate, alkyl sulfate, alkyl polyoxyethylene sulfate, alkyl phosphate, long-chain fatty acid salt, α-sulfo fatty acid ester salt, and alkyl ether sulfate; and bonding the anion to alkali metal ion such as natrium and kalium, alkali earth metal ion such as magnesium and calcium, metal ion such as aluminum and zinc, and ammonium ion.

Examples of the cationic surfactant include compounds containing cation at the end of a hydrophobic portion such as alkyltrimethyl ammonium salt, dialkyldimethyl ammonium salt, and alkyldimethyl benzyl ammonium salt; and boding the cation to chlorine, fluorine, bromine, phosphate ion, nitrate ion, sulfate ion, thiosulfate ion, carbonate ion, and hydroxy ion.

Examples of the zwitterionic surfactant include dimethylalkylamine oxide, N-alkylbetaine, imidazoline derivative, and alkyl amino acid.

Examples of the nonionic surfactant include alcohol compounds, ether compounds, and amido compounds such as long-chain alkyl alcohol, alkyl polyoxyethylene ether, polyoxyethylene alkyl phenyl ether, fatty acid diethanol amide, alkyl polyglucoxide, and polyoxyethylene sorbitan alkyl ester. Preferred examples thereof are long-chain alkyl carboxylic acid such as lauric acid, palmitic acid, stearic acid, behenic acid, lignoceric acid, cerotic acid, montan acid, and melissic acid; a polyalcahol group such as ethylene glycol, propylene glycol, glycerin, erythritol, and hexitol; and ester compounds of any of these and a partial anhydride.

More specific examples of the ester compounds include glyceryl alkylcarboxylate such as glyceryl monostearate, glyceryl distearate, glyceryl monopalmitate, glyceryl dilaurate, glyceryl trilaurate, glyceryl dipalmitate, glyceryl tripalmitate, glyceryl dimyristate, glyceryl trimyristate, glyceryl palmitate stearate, glyceryl monoarachidate, glyceryl diarachidate, glyceryl monobehenate, glyceryl stearate behenate, glyceryl cerotate stearate, glyceryl monomontanate, and glyceryl monomelissate, and substituted compounds thereof, sorbitan alkylcarboxylate such as sorbitan monostearate, sorbitan tristearate, sorbitan dipalmitate, sorbitan tripalmitate, sorbitan dimyristate, sorbitan trimyristate, sorbitan palmitate stearate, sorbitan monoarachidate, sorbitan monobehenate, sorbitan stearate behenate, sorbitan scerotate stearate, sorbitan monomontanate, and sorbitan monomelissate, and substituted compounds thereof, but the ester compounds are not limited thereto.

A plurality kinds of these amphiphilic organic compounds may be used.

Because the protecting agent is used near the image carrier arranged in the image forming apparatus, the protecting agent is often exposed to temperature atmosphere higher than the room temperature under continuous use because of heat generated from a heat source such as a drive system. Therefore, to keep the shape of the protecting agent during its use, it is necessary not to cause phase change such as melting of the composition of the protecting agent until the temperature reaches a certain temperature.

At the same time, to surely protect the surface of the image carrier from electrical stress, the protecting agent is preferably spread on the surface of the image carrier to form a protecting agent layer. To employ this configuration, it is preferred that intermolecular interaction of the protecting agent component is not too strong.

If the intermolecular interaction is strong, then a large amount of energy is necessary to change an intraphase structure that has been once formed. Therefore, a temperature at which the endothermic peak is generated measured by the Differential Scanning Calorimeter or a differential thermal analyzer becomes high.

Accordingly, to ensure spreading property of the protecting agent for the image carrier upon formation of the protecting agent layer while the shape of the protecting agent for the image carrier is maintained, the protecting agent preferably has at least one endothermic peak temperature in a range of 40° C. to 130° C. It is noted that the endothermic peak temperature indicates a temperature at a position of the endothermic peak in a differential thermal profile upon temperature rise, measured by using a differential thermal analyzer.

As a method of molding the protecting agent in a specific shape such as quadratic prism and cylinder, any one of known methods as a solid-material molding method can be used.

Examples of the method include a melting molding method, a powder molding method, a thermal pressing molding method, a cold isotropic pressing method (CIP), and a hot isotropic pressing method (HIP). However, the method is not limited by these examples.

Specifically, the melting molding method is explained below. A predetermined amount of protecting agent having been heated and melted is poured into a predetermined-shaped mold form which has previously been heated up to a melting temperature or higher of the protecting agent, and the protecting agent in the mold form is kept as it is for a certain time at a temperature of a melting point or higher according to need, and thereafter, the protecting agent is cooled down using a method of "standing to cool" or "cool removal", to obtain a molded unit. To remove inner distortion of the molded unit, the cooling is progressing to the temperature below a phase transition temperature of the protecting agent during the cooling, and then the molded unit may be slowly heated again to a temperature of the phase transition temperature or higher.

After cooled down to a temperature near the room temperature, the molded unit is removed from the mold form, to obtain the molded unit of the protecting agent. Thereafter, the shape of the protecting agent may be arranged by cutting machining.

The mold form is preferably a metal mold form such as steel material, stainless, and aluminum in view of better thermal conductive properties and better dimensional accuracy. The wall of the mold form is preferably coated with a release agent such as fluorine resin or silicone resin to improve releasing properties.

The protecting-layer forming device that applies the protecting agent according to the present invention to the surface of the image carrier is explained below.

The protecting-layer forming device according to the present invention includes the image carrier and units that perform processes in such a manner that the protecting agent according to the present invention is applied to the surface of the image carrier and a protecting layer is formed thereon. The protecting-layer forming device further includes other units as required.

A protecting-layer forming unit includes a pressing-force imparting unit that presses the protecting agent against a protecting-agent supplying unit, the protecting-agent supplying unit that supplies the protecting agent to the surface of the image carrier, and a protecting-layer forming unit that makes the supplied protecting agent be a thin layer to form a protecting layer on the surface of the image carrier. The protecting-layer forming unit further includes other components as necessary.

When the protecting-layer forming device includes the protecting-layer forming unit, the protecting-layer forming unit can be also used as the cleaning unit. However, to more reliably form the protecting layer, it is preferred to previously remove residues with toner as a main component from the image carrier by the cleaning unit and prevent the residues from not being entered into the protecting layer.

FIG. 1 is a schematic of one example of the protecting-layer forming device according to the present invention.

In FIG. 1, reference numeral 1 represents a photoconductor, 2 a protecting-layer forming device, 3 a charging roller (or charger), 4 a cleaning mechanism (or cleaning device), 21 a protecting agent for the image carrier (hereinafter, "protecting agent 21"), 22 a protecting-agent supplying unit, 23 a pressing-force imparting unit, 24 a protecting-layer forming unit (or protecting-layer forming mechanism), 41 a cleaning unit, and 42 a cleaning-unit pressing mechanism (or cleaning-unit pressing unit).

The protecting-layer forming device 2 arranged oppositely to a drum-type photoconductor 1, which is an image carrier, mainly includes the protecting agent 21 according to the present invention, the protecting-agent supplying unit 22, the pressing-force imparting unit 23, and the protecting-layer forming unit 24.

The protecting agent 21 is pressed by the pressing-force imparting unit 23 against the protecting-agent supplying unit 22 of, for example, a brush type. The protecting-agent supplying unit 22 is made to rotate with the rotation of the image carrier 1 based on a difference in linear velocity between the two so that the protecting-agent supplying unit 22 slidably contacts the surface of the image carrier 1, and during the contact, the protecting agent held on the surface of the protecting-agent supplying unit 22 is supplied to the surface of the image carrier 1.

There is a case where the protecting agent supplied to the surface of the image carrier is not always formed as an adequate protecting layer upon supply depending on selection of material types. Therefore, to form more uniform protecting layer, the protecting agent on the surface thereof is formed as a thin film by the protecting-layer forming unit that includes a blade-type unit, and the protecting agent thereby becomes a protecting layer.

The image carrier with the protecting layer formed thereon is charged by using the charging roller 3 that is provided in contact with or close to the image carrier and conducts electrical discharge in a fine space between the two. More specifically, the charging roller 3 is applied with a direct current (DC) voltage by a high-voltage power supply (not shown) or with a voltage obtained by superimposing an alternating current (AC) voltage on the DC voltage. At this time, part of the protecting layer is decomposed or oxidized caused by the electrical stress, and products due to electrical discharge in the air adhere to the surface of the protecting layer. These decomposed products, oxidative products, or products due to electrical discharge in the air are generally hydrophilic or include a hydrophilic group.

The protecting agent 21 contains both the amphiphilic organic compound having a hydrophilic portion and a hydrophobic portion within one molecule and the hydrophilic organic compound as compositions of the protecting agent. Therefore, the amphiphilic organic compound is attracted to a portion of the surface of the image carrier which is modified to be hydrophilic caused by the electrical stress, and the attraction causes the surface of the image carrier to be hydrophobic, which prevents the electrical stress from being directly loaded to the surface of the image carrier. The part of the protecting agent is exposed to the electrical stress to be degraded instead, and this causes the protecting agent to be partially hydrophilic. However, the partial hydrophilic portion of the protecting agent is taken in redundantly existing hydrophilic pockets and dispersed in the protecting layer. Therefore, it is possible to balance the protection effect of the image carrier by the protecting layer and the removal capability of a degraded protecting agent from the image carrier.

The degraded protecting agent is removed together with the components of the toner remaining on the image carrier, by the ordinary cleaning mechanism. The cleaning mechanism can be also used as the protecting-layer forming unit. However, the function of removing the residues from the surface of the image carrier is preferably separated from the function of forming the protecting layer because respectively appropriate units may have different sliding conditions. The cleaning mechanism 4 including the cleaning unit 41 and the cleaning-unit pressing mechanism 42 is preferably arranged on the upstream side of the protecting-agent supplying unit as shown in FIG. 1.

Materials of the blade used for the protecting-layer forming unit are not particularly limited, and therefore can be suitably selected from among those generally known as a material for the cleaning blade, depending on the application. Examples of the material include urethane rubber, hydrin rubber, silicone rubber, and fluoro rubber. These can be used singly or in combination of two or more. A contact portion of each of these blades with the image carrier may be subjected to coating or to a dipping process using any material with a low friction coefficient. To adjust the hardness of an elastic unit, a filler such as organic filler or inorganic filler may be dispersed in the material.

The cleaning blade is fixed to a blade support by using an arbitrary method such as bonding or fusion bonding so that the edge of the blade can be pressed to contact the surface of the image carrier. The thickness of the blade is not uniquely defined because it depends on the pressing force, however, a range of 0.5 millimeter to 5 millimeters is preferable, and a range of 1 millimeter to 3 millimeters is more preferable.

The length i.e. free length of the cleaning blade which protrudes from the blade support and allows deflection thereof is not also uniquely defined because it depends on the pressing force. However, a range of 1 millimeter to 15 millimeters is preferable, and a range of 2 millimeters to 10 millimeters is more preferable.

Other structures of the blade unit for forming the protecting layer are as follows. That is, a covering layer of resin, rubber, or elastomer may be formed on the surface of an elastic metal blade such as a spring plate via a coupling agent or a primer component if necessary using a method of coating or dipping, subjected to thermosetting as required, and further subjected to surface polishing or the like as necessary.

The covering layer contains at least binder resin and a filler and further contains some other components as required.

The binder resin is not particularly limited, and therefore can be suitably selected depending on the application. Examples of the binder resin include fluorine resin such as PFA, PTFE, FEP, and PVdF; and a silicone base elastomer such as fluororubber and methylphenyl silicone elastomer.

The thickness of the elastic metal blade is preferably in a range of 0.05 millimeter to 3 millimeters, and more preferably a range of 0.1 millimeter to 1 millimeter. To prevent torsion of the elastic metal blade, the blade may be subjected to a process such as bending in a direction substantially parallel to a spindle after being fixed.

The force to press the image carrier by the protecting-layer forming unit is only required as force with which the protecting agent is spread to be formed as a protecting layer. Therefore, as a linear pressure, a range of 5 gf/cm to 80 gf/cm is preferable, and a range of 10 gf/cm to 60 gf/cm is more preferable.

A brush type material is preferably used as a protecting-agent supplying unit. However, in this case, to suppress mechanical stress to the surface of the image carrier, brush fibers preferably have flexibility.

The specific materials of the flexible brush fibers are not limited, and can be selected as required. For example, any resin having flexibility of those as follows can be used: polyolefin resin such as polyethylene and polypropylene; polyvinyl and polyvinylidene resins such as polystyrene, acrylic resin, polyacrylonitrile, polyvinyl acetate, polyvinyl alcohol, polyvinyl butyral, polyvinyl chloride, polyvinyl carbazole, polyvinyl ether, and polyvinyl ketone; vinyl chloride-vinyl acetate copolymer; styrene-acrylic acid copolymer; styrene-butadiene resin; fluorine resin such as polytetrafluoroethylene, polyvinyl fluoride, polyvinylidene fluoride, and polychloro-trifluoroethylene; polyester; nylon; acryl; rayon; polyurethane; polycarbonate; phenol resin; and amino resin such as urea-formaldehyde resin, melamine resin, benzoguanamine resin, urea resin, and polyamide resin. Furthermore, to adjust the degree of deflection, those as follows may be used in a combined manner: diene rubber, styrene-butadiene rubber (SBR), ethylene propylene rubber, isoprene rubber, nitrile rubber, urethane rubber, silicone rubber, hydrin rubber, and norbornen rubber.

The support of the protecting-agent supplying unit includes a fixed type and a rotatable roll type. One of roll-type supplying units is a roll brush obtained by spirally winding a pile type tape made from brush fibers around a core metal. The brush fibers having those conditions as follows are preferably used. That is, the diameter of the brush fiber ranges from about 10 micrometers to 500 micrometers, the length thereof ranges from 1 micrometer to 15 millimeters, and the density thereof ranges from 10,000 lines per square inch to 300,000 lines per square inch ($1.5\times10^7$ lines per square meter to $4.5\times10^8$ lines per square meter).

As the protecting-agent supplying unit, it is preferable that a material with high brush density is used as possible as it can be, in terms of uniformity and stability when the protecting agent is supplied. It is also preferable that one fiber is made from several lines to hundreds lines of fine fibers. For example, 50 fine fibers of 6.7 decitexes (6 deniers) are tied in a bundle, like 333 decitexes=6.7 decitexes×50 filaments (300 deniers=6 deniers×50 filaments), and it is preferable that the bundle as one fiber is planted in the brush.

A coating layer may be formed on the surface of the brush to stabilize the shape of the surface and environmental stability of the brush as required. As a component to form the coating layer, it is preferable to use a coating layer component capable of deforming according to the deflection of the brush fibers. Any material can be used if it can keep flexibility. Examples thereof are polyolefin resin such as polyethylene, polypropylene, chlorinated polyethylene, and chlorosulfonated polyethylene; polyvinyl and polyvinylidene resin such as polystyrene and acryl such as polymethyl methacrylate, polyacrylonitrile, polyvinyl acetate, polyvinyl alcohol, polyvinyl butyral, polyvinyl chloride, polyvinyl carbazole, polyvinyl ether, and polyvinyl ketone; vinyl chloride-vinyl acetate copolymer; silicone resin of organosiloxane bonding or its modified product of such as alkyd resin, polyester resin, epoxy resin, and polyurethane; fluorine resin such as perfluoroalkyl ether, polyvinyl fluoride, polyvinylidene fluoride, and polychloro-trifluoroethylene; polyamide; polyester; polyurethane; polycarbonate; and amino resin such as urea-formaldehyde resin; epoxy resin; and composite resin of these materials.

An image forming method and an image forming apparatus are explained below.

The image forming method according to the present invention includes an electrostatic-latent-image forming process, a developing process, a transfer process, a protecting-layer forming process, and a fixing process, preferably includes a cleaning process, and further includes other processes suitably selected as required such as a neutralizing process, a recycling process, and a control process.

The image forming apparatus according to the present invention includes an image carrier, an electrostatic-latent-image forming unit, a developing unit, a transfer unit, a protecting-layer forming unit, and a fixing unit, preferably includes a cleaning unit, and further includes other units suitably selected as required such as a neutralizing unit, a recycling unit, and a control unit.

The image forming method according to the present invention can optimally be implemented by the image forming apparatus according to the present invention. More specifically, the electrostatic-latent-image forming process can be performed by the electrostatic-latent-image forming unit, the developing process by the developing unit, the transfer process by the transfer unit, the protecting-layer forming process by the protecting-layer forming unit, the fixing process by the fixing unit, and the other processes by the other units.

At first, the electrostatic-latent-image forming process and the electrostatic-latent-image forming unit are explained below.

The electrostatic-latent-image forming process is a process of forming an electrostatic latent image on the image carrier.

The material, shape, structure, and size, and the like of the image carrier (sometimes called "electrostatic latent image carrier" and "photoconductor") are not particularly limited, and thus any ones can be selected from among known suitable materials. As the shape of the image carrier, a drum shape is preferred. Examples of the material include an inorganic photoconductor such as amorphous silicon and selenium, and an organic photoconductor such as polysilane and phthalopolymethine.

The image carrier (photoconductor) used in the image forming apparatus includes a conductive support and at least a photoconductive layer provided on the conductive support, and further includes other layers as required.

As the photoconductive layer, there is a single layer type in which a charge generation material and a charge transport material are provided, a normal laminated type in which a charge transport layer is provided on a charge generation layer, or a reverse laminated type in which a charge generation layer is provided on a charge transport layer. A protecting layer can also be provided on the photoconductive layer to improve mechanical strength, wear resistance, gas resistance, and cleaning performance of the photoconductor. An undercoat layer may also be provided between the photoconductive layer and the conductive support. Furthermore, a plasticizer, an antioxidant, and a leveling agent can also be added by an appropriate amount to each layer if necessary.

As the conductive support of the photoconductor, a conductive unit having a volume resistivity of $1.0\times10^{10}\Omega\cdot$cm or less is not limited, and can be selected for the purpose. The conductive unit includes one obtained by coating metal or a metal oxide on a film-like or cylindrical plastic or a sheet of paper by evaporation or spattering. More specifically, the metal includes aluminum, nickel, chrome, nichrome, copper, gold, silver, and platinum; and the metal oxide includes tin oxide and indium oxide. The conductive unit also includes a plate of aluminum, aluminum alloy, nickel, or stainless steel; and a tube obtained by forming a drum-shape unit tube with any one of the plates using an extrusion or an extraction method, and subjecting the unit tube to surface treatment such as cutting, superfinishing, and polishing. Any drum-shape support as follows can be used: a diameter thereof is 20 millimeters to 150 millimeters, preferably 24 millimeters to 100 millimeters, and more preferably 28 millimeters to 70 millimeters. If the diameter thereof is less than 20 millimeters, it is not preferred because it may be physically difficult to arrange processes such as charging, exposure, development, transfer, and cleaning around the drum. If the diameter is more than 150 millimeters, the size of the image forming apparatus may increase. Particularly, a tandem type image forming apparatus needs to have a plurality of photoconductors, and for this reason, the diameter of each photoconductor is 70 millimeters or less, preferably 60 millimeters or less. A known endless nickel belt or a known endless stainless belt can also be used as the conductive support.

The undercoat layer of the photoconductor may be configured to single layer or multiple layers. Examples of the undercoat layer include resin as a main component, a material containing white pigment and resin as a main component, and a metal oxide film obtained by chemically or electro-chemically oxidizing the surface of a conductive base. Among these, the material containing white pigment and resin as a main component is preferable. Examples of the white pigment include metal oxides such as titanium oxide, aluminum oxide, zirconium oxide, and zinc oxide, and it is most preferable to contain the titanium oxide which is excellent in capability of preventing charge injection from a conductive substrate. Examples of the resin include thermoplastic resin such as polyamide, polyvinyl alcohol, casein, and methylcellulose; thermosetting resin such as acryl, phenol, melamine, alkyd, unsaturated polyester, and epoxy. These may be used singly or in combination of two or more.

The thickness of the undercoat layer is not limited, and can be selected as required, a range of 0.1 micrometer to 10 micrometers is preferable, and 1 micrometer to 5 micrometers is more preferable.

Examples of the charge generation material of the photoconductor include azo pigment such as monoazo pigment, bisazo pigment, trisazo pigment, and tetrakisazo pigment; organic pigments or dyes such as triallylmethane dyes, thiazine dyes, oxazine dyes, xanthene dyes, cyanine dyes, styryl pigment, pyrylium dyes, quinacridone pigment, indigo pigment, perylene pigment, polycyclic quinone pigment, bisbenzimidazol pigment, indanthrene pigment, squarylium pigment, and phthalocyanine pigment; inorganic materials such as selenium, selenium-arsonic, selenium-tellurium, cadmium sulfide, zinc oxide, titanium oxide, and amorphous silicon, and these can be used singly or in combination of two or more. The undercoat layer may be one layer or a plurality of layers.

Examples of the charge transport material of the photoconductor used in the image forming apparatus include anthracene derivatives, pyrene derivatives, carbazole derivatives, tetrazole derivatives, metallocene derivatives, phenothiazine derivatives, pyrazoline compounds, hydrazone compounds, styryl compounds, styryl hydrazone compounds, enamine compounds, butadiene compounds, distyryl compounds, oxazole compounds, oxadiazole compounds, thiazole compounds, imidazole compounds, triphenylamine derivatives, phenylene diamine derivatives, aminostilbene derivatives, and triphenylmethane derivatives, and these can be used singly or in combination of two or more.

A binder resin for use in formation of the photoconductive layer has electrical insulation property, and known resins with this property such as thermoplastic resin, thermosetting resin, light-curing resin, and photoconductive resin can be used. Examples of an appropriate binder resin include thermoplastic resin such as polyvinyl chloride, polyvinylidene chloride, vinyl chloride-vinyl acetate copolymer, vinyl chloride-vinyl acetate-maleic anhydride copolymer, ethylene-vinyl acetate copolymer, polyvinyl butyral, polyvinyl acetal, polyester, phenoxy resin, (meth)acrylic resin, polystyrene, polycarbonate, polyarylate, polysulphone, polyethersulphone, and ABC resin; thermosetting resin such as phenyl resin, epoxy resin, urethane resin, melamine resin, isocyanate resin, alkyd resin, silicone resin, thermosetting acrylic resin; and photoconductive resin such as polyvinyl carbazole, polyvinyl anthracene, and polyvinyl pyrene, and these can be used singly or as a mixture of two or more binder resins but the binder resin is not limited thereto.

Examples of the antioxidant include phenol compounds, paraphenylenediamine groups, organic sulfur compounds, and organic phosphorus compounds. Examples of the phenol compounds include 2,6-di-t-butyl-p-cresol, butylated hydroxyanisole, 2,6-di-t-butyl-4-ethylphenol, stearyl-β-(3,5-di-t-butyl-4-hydroxyphenyl)propionate, 3-t-butyl-4-hydroxynisole, 2,2'-methylene-bis(4-methyl-6-t-butylphenol), 2,2'-methylene-bis(4-ethyl-6-t-butylphenol), 4,4'-thiobis(3-methyl-6-t-butylphenol), 4,4'-butylidenebis(3-methyl-6-t-butylphenol), 1,1,3-tris(2-methyl-4-hydroxy-5-t-butylphenyl)butane, 1,3,5-trimethyl-2,4,6-tris(3,5-di-t-butyl-4-hydroxybenzyl)benzene, tetrakis[methylene-3-(3',5'-di-t-butyl-4'-hydroxyphenyl)propionate]methane, bis[3,3'-bis(4'-hydroxy-3'-t-butylphenyl)butyric acid]glycol ester, and tocophenols.

Examples of the paraphenylenediamine groups include N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, and N,N'-dimethyl-N,N'-di-t-butyl-p-phenylenediamine.

Examples of the hydroquinone groups include 2,5-di-t-octylhydroquinone, 2,6-didodecylhydroquinone, 2-dodecylhydroquinone, 2-dodecyl-5-chlorohydroquinone, 2-t-octyl-5-methylhydroquinone, and 2-(2-octadecenyl)-5-methylhydroquinone.

Examples of the organic sulfur compounds include dilauryl-3,3'-thiodipropionate, distearyl-3,3'-thiodipropionate, and ditetradecyl-3,3'-thiodipropionate. Examples of the organic phosphorus compounds include triphenylphosphine, tri(nonylphenyl)phosphine, tri(dinonylphenyl)phosphine, tricresylphosphine, and tri(2,4-dibutylphenoxy)phosphine.

As the plasticizer, an ordinary resin plasticizer such as dibutyl phthalate and dioctyl phthalate can be used as it is. The content of the plasticizer is preferably from about 0 parts by weight to 30 parts by weight per 100 parts by weight of the binder resin.

The leveling agent is allowed to be added to the photoconductive layer. Examples of the leveling agent include silicone oils such as dimethyl silicone oils and methylphenyl silicone oils; and polymers or oligomers having a perfluoroalkyl group in their side chain. The content of the leveling agent in the charge transport layer is preferably from 0 part by weight to 1 part by weight per 100 parts by weight of the binder resin.

The outermost surface layer of the photoconductor is provided to improve mechanical strength, wear resistance, gas resistance, and cleaning performance of the photoconductor.

As the surface layer, a layer made of polymer with higher mechanical strength than that of the photoconductive layer, and a layer obtained by dispersing inorganic filler in the polymer are preferable. The resin used for the surface layer may be either one of thermoplastic resin and thermosetting resin. However, the thermosetting polymer is more preferable because of its high mechanical strength and extremely high capability to suppress wear due to friction with the cleaning blade.

If the surface layer is thin in thickness, no trouble occurs even if it does not have charge transport capability. However, if the surface layer without charge transport capability is formed thick, then the thick surface layer easily causes reduction in sensitivity of the photoconductor, an increase in potential after exposure, and also an increase in residual potential. Therefore, it is preferred to cause the charge transport material to be contained in the surface layer or to use a material having the charge transport capability as polymer used for the surface layer.

Generally, the mechanical strength of the photoconductive layer is largely different from that of the outermost surface layer. Consequently, if the outermost surface layer is worn and removed due to friction with the cleaning blade, then the photoconductive layer starts wearing at once. Therefore, if the outermost surface layer is provided, the outermost surface layer is important to have an adequate thickness. The thickness is from 0.01 micrometer to 12 micrometers, preferably 1 micrometer to 10 micrometers, and more preferably 2 micrometers to 8 micrometers.

If the thickness of the surface layer is 0.1 micrometer or less, the surface layer may be too thin, part of the surface layer is easily removed due to friction with the cleaning blade, and the wear of the photoconductor progresses from the removed portion. If the thickness of the surface layer is 12 micrometers or more, then the thick surface layer easily causes reduction in sensitivity of the photoconductor, an increase in potential after exposure, and also an increase in residual potential. Particularly, if the polymer having the charge transport capability is used, the cost of the polymer having the charge transport capability may be increased.

Desirable resin used for the surface layer is transparent with respect to a write beam upon image formation, and excellent in insulation, mechanical strength, and adhesiveness. Examples of the polymer are ABS resin, ACS resin, olefin-vinyl monomer copolymer, chlorinated polyether, aryl resin, phenol resin, polyacetal, polyamide, polyamide-imide, polyacrylate, polyarylsulphone, polybutylene, polybutylene terephthalate, polycarbonate, polyethersulphone, polyethylene, polyethylene terephthalate, polyimide, acrylic resin, polymethylpentene, polypropylene, polyphenylenoxide, polysulphone, polystyrene, AS resin, butadiene-styrene copolymer, polyurethane, polyvinyl chloride, polyvinylidene chloride, and epoxy resin. These polymers may be thermoplastic polymers, but to enhance the mechanical strength of the polymer, the cross-link is made using a cross-linking agent having polyfunctional acryloyl group, carboxyl group, hydroxyl group, amino group, and the like, to obtain thermosetting polymer. The obtained thermosetting polymer allows increase in mechanical strength of the surface layer and large reduction in wear due to friction with the cleaning blade.

It is preferable that the outermost surface layer has the charge transport capability. To provide the charge transport capability to the outermost surface layer, there are two methods: a method of using a mixture of the polymer used for the outermost surface layer and the charge transport material, and a method of using the polymer having the charge transport capability for the outermost surface layer. The latter one is preferred because the photoconductor highly sensitive and with less increase of potential after exposure and less increase of residual potential can be obtained.

An example of the polymer having the charge transport capability can be a group having the charge transport capability in the polymer expressed by

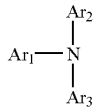

(1)

where $Ar_1$ represents arylene group which may have substituted group in Formula (1). $Ar_2$ and $Ar_3$ represent aryl groups which may have individually substituted groups, and both of them can be the same as or different from each other.

Such as a group having the charge transport capability is preferably added to the side chain of a polymer with the high mechanical strength such as polycarbonate resin and acrylic resin, and the acrylic resin is preferably used because it is easy to manufacture monomer and is excellent in coating capability and setting capability.

By polymerizing acrylic resin having the charge transport capability with unsaturated carboxylic acid having the groups in Formula (1), it is possible to form the surface layer having high mechanical strength and charge transport capability, and being excellent in transparency. By mixing the unsaturated carboxylic acid having the monofunctional groups in Formula (1) with polyfunctional unsaturated carboxylic acid, preferably 3 or more functional unsaturated carboxylic acid, the acrylic resin forms a cross-linked structure, which becomes thermosetting polymer. With these processes, the mechanical strength of the surface layer becomes extremely high. The groups in Formula (1) may be added to the polyfunctional unsaturated carboxylic acid. However, manufacturing cost of monomer increases, and thus, it is preferred not to add the groups in Formula (1) to the polyfunctional unsaturated carboxylic acid, but to use light-curable polyfunctional monomer instead.

Examples of monofunctional unsaturated carboxylic acid having the groups in Formula (1) are as shown in Formula (2) and Formula (3) as follows.

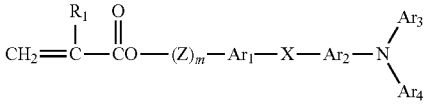

(2)

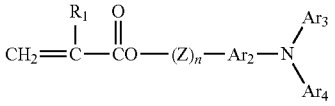

(3)

where $R_1$ represents a hydrogen atom, a halogen atom, an alkyl group which may have a substituted group, an aralkyl group which may have a substituted group, an aryl group which may have a substituted group; a cyano group, a nitro group; an alkoxy group, —$COOR_7$ ($R_7$ represents a hydrogen atom, an alkyl group which may have a substituted group, an aralkyl group which may have a substituted group, or an aryl group which may have a substituted group), a carbonyl halide group, or $CONR_8R_9$ ($R_8$ and $R_9$ represent a hydrogen atom, a halogen atom, an alkyl group which may have a substituted group, an aralkyl group which may have a substituted group, or an aryl group which may have a substituted group and both of them can be the same as or different from each other) in Formula (2) and Formula (3).

$Ar_1$ and $Ar_2$ represent individually substituted or unsubstituted arylene groups and both of them can be the same as or different from each other in Formula (2) and Formula (3).

$Ar_3$ and $Ar_4$ represent individually substituted or unsubstituted aryl groups, and both of them can be the same as or different from each other in Formula (2) and Formula (3).

X represents a single bond, a substituted or unsubstituted alkylene group, a substituted or unsubstituted cycloalkylene group, a substituted or unsubstituted alkylene ether group, an oxygen atom, a sulfur atom, and a vinylene group in Formula (2) and Formula (3). Z represents a substituted or unsubstituted alkylene group, a substituted or unsubstituted alkylene ether divalent group, and an alkylene oxycarbonyl divalent group in Formula (2) and Formula (3).

Each of m and n represents an integer of 0 to 3.

In Formula (2) and Formula (3), an alkyl group in a substituted group of $R_1$ includes a methyl group, an ethyl group, a propyl group, and a butyl group. An aryl group includes a phenyl group and a naphthyl group. An aralkyl group includes a benzyl group, a phenethyl group, and a naphthyl methyl group. An alkoxy group includes a methoxy group, an ethoxy group, and a propoxy group. These may be substituted by a halogen atom, a nitro group, a cyano group; alkyl groups such as a methyl group and an ethyl group; alkoxy groups such as a methoxy group and an ethoxy group; aryloxy groups such as a phenoxy group; aryl groups such as a phenyl group and a naphthyl group; and aralkyl groups such as a benzyl group and a phenethyl group. Among the substituted groups of $R_1$, a hydrogen atom or a methyl group is particularly preferred.

Aryl groups of $Ar_3$ and $Ar_4$ include a condensed polycyclic hydrocarbon group, a non-condensed cyclic hydrocarbon group, or a heterocyclic group.

The condensed polycyclic hydrocarbon group is preferably one having 18 or less carbon atoms to form a ring, including, for example, a pentanyl group, an indenyl group, a naphthyl group, an azulenyl group, a heptalenyl group, a biphenylenyl group, as-indacenyl group, s-indacenyl group, a fluorenyl group, an acenaphthylenyl group, a pleiadenyl group, an acenaphthenyl group, a phenalenyl group, a phenanthryl group, an antholyl group, a fluoranthenyl group, an acephenanthrylenyl group, an aceanthrylenyl group, a triphenylenyl group, a pyrenyl group, a chrysenyl group, and a naphthacenyl group.

The non-condensed cyclic hydrocarbon group includes monovalent groups of a monocyclic hydrocarbon compound such as benzene, diphenyl ether, polyethylene diphenyl ether, diphenyl thioether, and diphenyl sulfone; monovalent groups of a non-condensed polycyclic hydrocarbon compound such as biphenyl, polyphenyl, diphenyl alkane, diphenyl alkene, diphenyl alkyne, triphenyl methane, distyryl benzene, 1,1-diphenylcycloalkane, polyphenyl alkane, and polyphenyl alkene; and monovalent groups of a ring assembly hydrocarbon compound such as 9,9-diphenylfluorene.

The heterocylic group includes monovalent groups of carbazole, dibenzofuran, dibenzothiophene, oxadiazole, and thiadiazole.

The content of the polyfunctional unsaturated carboxylic acid is 5 wt % to 75 wt % of the entire outermost surface layer, more preferably 10 wt % to 70 wt %, further preferably 20 wt % to 60 wt %. If the content is below 5 wt %, it is not preferred because the mechanical strength of the outermost surface layer is insufficient. If it is 75 wt % or more, the outermost surface layer may easily be cracked when the strong force is applied thereto and sensitivity may easily be degraded.

When the acrylic resin is used for the outermost surface layer, the surface layer can be formed by coating the unsaturated carboxylic acid to the photoconductor, and irradiating electron beams or active rays such as ultraviolet rays thereto to cause radical polymerization. When the radical polymerization is conducted by the active rays, a solution in which a photopolymerization initiator is dissolved in the unsaturated carboxylic acid. As the photopolymerization initiator, a material used for light-curable paint can be usually used.

To enhance the mechanical strength of the outermost surface layer, fine particles of metal, fine particles of metal oxide, or the other particles is preferred. Examples of metal oxide are titanium oxide, tin oxide, potassium titanate, TiO, TiN, zinc oxide, indium oxide, and antimony oxide. In addition to these materials, fluorine resin such as polytetrafluoroethylene, silicone resin, and a material obtained by dispersing non-organic matter to any of these resins can be added to improve the wear resistance.

The electrostatic latent image can be formed by using the electrostatic-latent-image forming unit in such a manner that the surface of the image carrier is uniformly charged and then the charged surface is exposed to light based on the image data. The electrostatic-latent-image forming unit includes a charger that uniformly charges the surface of the image carrier, and an exposure unit that exposes the surface of the image carrier to light based on the image data.

The charging is implemented by, for example, applying a voltage to the surface of the image carrier using the charger.

The charger is not particularly limited and therefore can be suitably selected depending on the application. For example, the charger includes a known contact charger including conductive or semi-conductive roller, brush, film, rubber blade, or the like, and also includes a non-contact charger using corona discharging such as a corotron and a scorotron.

A preferred charger has a voltage applying unit that applies a voltage having an AC component.

The exposure can be performed by exposing the surface of the image carrier to light based on image data using, for example, the exposure unit.

The exposure unit is not particularly limited if the surface of the image carrier charged by the charger can be exposed to light based on the image data to be formed, and thus any one can be suitably selected depending on the application. Examples of the exposure unit include a copy optical system, a rod lens array system, a laser optical system, and a liquid-crystal shutter optical system.

In addition, a backlight system in which the image carrier is exposed to light based on the image data from its rear side may be employed in the present invention.

The developing process and the developing unit are explained below.

The developing process is a process of developing the electrostatic latent image using toner or developer to form a visible image.

The visible image can be formed by, for example, developing the electrostatic latent image using the toner or the developer, which can be performed by the developing unit.

The developing unit is not particularly limited if it can develop the image by using the toner or the developer, and therefore can be suitably selected from among known ones. A preferred developing unit includes those each of which includes at least a developing device that accommodates the toner or the developer and that can supply the toner or the developer to the electrostatic latent image in a contact or non-contact manner.

The toner preferably has an average circularity of 0.93 to 1.00, more preferably 0.95 to 0.99. A value obtained by the following equation is defined herein as circularity. The circularity is an index of the degree of irregularities of toner particles, and if the value is 1.00, then the shape of toner is perfect sphericity, and if the surface profile is more irregular, is getting a smaller value. The circularity is represented as Circularity SR=Circumferential length of a circle having an area equivalent to a projected area of a particle/Circumferential length of a projected image of the particle.

If the average circularity is in a range of 0.93 to 1.00, then respective surfaces of the toner particles are smooth, and each contact area between a toner particle and the photoconductor is small, which allows excellent transfer performance. Toner particles have no angular portions, mixing torque of the developer in the developing device is small and mixing is stably driven, which does not cause defective images. Because there are no angular toner particles in the toner particles to form dots, when the toner particles are press-contacted with the transfer material upon transfer, the pressure is evenly applied to all the toner particles forming dots, and voids due to improper transfer thereby hardly occur. Because the toner particles are not angular-shaped, grinding force thereof is small, and thus, the toner particles do not damage the surface of the photoconductor nor wear the surface thereof.

The circularity SR, for example, can be measured by using Particle Analyzer FPIA-1000 manufactured by Toa Medical Electronics.

At first, water of 100 milliliters to 150 milliliters from which impurity solid is previously removed is put into a container, a surfactant (preferably, alkylbenzene sulfonic acid) being a dispersing agent is added by 0.1 milliliter to 0.5 milliliter to the water, and sample to be measured is further added thereto by about 0.1 gram to 0.5 gram. A suspension with the sample dispersed therein is dispersed for about 1 minute to 3 minutes by an ultrasonic disperser, and concentration of a dispersing solution is controlled to 3,000 pieces/μl to 10,000 pieces/μl, and each shape and particle size of toner particles are thereby measured.

A weight-average particle size (D4) of toner is preferably 3 micrometers to 10 micrometers, and more preferably 4 micrometers to 8 micrometers. In this range, the particle size of toner particles is sufficiently small with respect to fine dots of the latent image, and thus the toner particles are excellent in dot reproducibility. If the weight-average particle size (D4) is below 3 micrometers, then phenomena such as decrease in transfer efficiency and degradation of blade cleaning performance are easily occur. If the weight-average particle size (D4) exceeds 10 micrometers, then it is difficult to suppress "toner flying" of toner supposed to form a character and a line.

As for the toner, a ratio (D4/D1) between the volume-average particle size (D4) and a number-average particle size (D1) is preferably 1.00 to 1.40, and more preferably 1.00 to 1.30. If the value of (D4/D1) is closer to unity, a particle size distribution of toner particles is sharper. Therefore, if (D4/D1) is in a range of 1.00 to 1.40, then selective development due to the toner particle size does not occur, and thus the toner is excellent in stability of image quality. Because the particle-size distribution of the toner is sharp, a distribution of triboelectrically-charged amounts is also sharp, and occurrence of fogging can thereby be suppressed. If toner particle sizes are uniform, the toner particles are developed onto dots of the latent image so as to be arrayed in a finely and orderly manner, thus being excellent in dot reproducibility.

The volume-average particle size and a particle-size distribution of toner particles is measured based on Coulter Counter method. Examples of a measurement device of a particle-size distribution of toner particles based on Coulter Counter method are Coulter Counter TA-II and Coulter Counter Multisizer II (both manufactured by Coulter Co.).

A surfactant (preferably, alkylbenzene sulfonic acid) being a dispersing agent is added by 0.1 milliliter to 5 milliliters into 100 milliliters to 150 milliliters of electrolytic solution. The electrolytic solution is obtained by preparing about 1% NaCl aqueous solution by using primary sodium chloride, and for example, ISOTON-II (manufactured by Coulter Co.) can be used to prepare it. Sample to be measured is further added thereto by 2 milligrams to 20 milligrams. An electrolytic solution with the sample suspended therein is dispersed for about 1 minute to 3 minutes by an ultrasonic disperser. The measurement device is used to measure the volume and the number of toner particles or toner using 100 μm-aperture and calculate a volume distribution and a number distribution. From the obtained distributions, the weight-average particle size (D4) of toner and the number-average particle size (D1) can be determined.

As a channel, 13 channels as follows are used and particles having a particle size not less than 2.00 micrometers to less than 40.30 micrometers are targeted: in micrometers, 2.00 to less than 2.52, 2.52 to less than 3.17, 3.17 to less than 4.00, 4.00 to less than 5.04, 5.04 to less than 6.35, 6.35 to less than 8.00, 8.00 to less than 10.08, 10.08 to less than 12.70, 12.70 to less than 16.00, 16.00 to less than 20.20, 20.20 to less than 25.40, 25.40 to less than 32.00, and 32.00 to less than 40.30.

The substantially spherical-shaped toner is preferably toner formed by crosslinking reaction and/or elongation reaction of a toner composition in an aqueous medium in the presence of resin fine particles. Specifically, the toner composition contains a polyester prepolymer having a functional group that contains nitrogen atoms, a polyester, a colorant, and a release agent. The toner manufactured using the reaction hardens the toner surface, which allows reduction in toner hot offset, and thus, it can be suppressed that the fixing device is contaminated with the toner which results in dirt appearing on an image.

An example of prepolymer formed of the modified polyester resin includes an isocyanate group-containing polyester prepolymer (A), and an example of compounds that elongate or cross-link with the prepolymer includes an amine group (B).

Examples of the isocyanate group-containing polyester prepolymer (A) include reaction products of a polyester with a polyisocyanate compound (3), and the like. More specifically, the polyester is a polycondensation product between a polyol (1) and a polycarboxylic acid (2), and has an active hydrogen group. Examples of the active hydrogen group of the polyester are hydroxyl groups such as an alcoholic hydroxyl group and a phenolic hydroxyl group, an amino group, a carboxyl group, a mercapto group, and the like. Among them, the alcoholic hydroxyl group is preferred.

Examples of polyol (1) include diol (1-1) and trivalent or more polyhydric alcohols (1-2); and (1-1) alone or a mixture of (1-1) with a small amount of (1-2) is preferable. Examples of diol (1-1) include alkylene glycol (e.g., ethylene glycol, 1,2-propylene glycol, 1,3-propylene glycol, 1,4-butanediol, and 1,6-hexanediol); alkylene ether glycols (e.g., diethylene glycol, triethylene glycol, dipropylene glycol, polyethylene glycol, polypropylene glycol, and polytetramethylene ether glycol); alicyclic diols (e.g., 1,4-cyclohexane dimethanol, and hydrogenated bisphenol A); bisphenols (e.g., bisphenol A, bisphenol F, and bisphenol S); adducts of alkylene oxide of the alicyclic diols (e.g., ethylene oxide, propylene oxide, and butylene oxide); and adducts of alkylene oxide of the bisphenols (e.g., ethylene oxide, propylene oxide, and butylene oxide). Among these, alkylene glycol having a carbon number from 2 to 12 and the adducts of alkylene oxides of the bisphenols are preferable. Particularly preferable are the adducts of alkylene oxides of the bisphenols, and a combination of the adducts of alkylene oxides of the bisphenols and alkylene glycol having a carbon number from 2 to 12.

Trivalent or more polyhydric alcohols (1-2) include trihydric to octahydric alcohols and more aliphatic alcohols (e.g., glycerol, trimethylolethane, trimethylolpropane, pentaerythritol, and sorbitol); trivalent or more phenols (e.g., trisphenol PA, phenol novolak, and cresol novolak); and adducts of alkylene oxides of the trivalent or more polyphenols.

Examples of the polycarboxylic acids (2) include a dicarboxylic acids (2-1) and a trivalent or more polycarboxylic acids (2-2); and (2-1) alone and a mixture of (2-1) and a small amount of (2-2) are preferable.

Examples of dicarboxylic acids (2-1) include alkylene dicarboxylic acids (e.g., succinic acid, adipic acid, and sebacic acid); alkenylene dicarboxylic acids (e.g., maleic acid and fumaric acid); and aromatic dicarboxylic acids (e.g., phthalic acid, isophthalic acid, terephthalic acid, and naphthalene dicarboxylic acid). Among these, the alkenylene dicarboxylic acids having a carbon number from 4 to 20 and the aromatic dicarboxylic acids having a carbon number from 8 to 20 are preferred.

Examples of trivalent or more carboxylic acids (2-2) include aromatic polycarboxylic acids having a carbon number from 9 to 20 (e.g., trimellitic acid and pyromellitic acid). The polycarboxylic acids (2) may be reacted with polyol (1) using acid anhydrides of these or lower alkyl esters (e.g., methyl ester, ethyl ester, and isopropyl ester).

A ratio between the polyol (1) and the polycarboxylic acid (2) is usually from 2/1 to 1/1, preferably from 1.5/1 to 1/1, more preferably from 1.3/1 to 1.02/1, as an equivalent ratio of [OH]/[COOH] between a hydroxyl group [OH] and a carboxyl group [COOH].

Examples of polyisocyanate (3) are aliphatic polyisocyanates (e.g., tetramethylene diisocyanate, hexamethylene diisocyanate, and 2,6-diisocyanate methyl caproate); alicyclic polyisocyanates (e.g., isophorone diisocyanate and cyclohexylmethane diisocyanate); aromatic diisocyanates (e.g., tolylene diisocyanate and diphenylmethane diisocyanate); aromatic aliphatic diisocyanates (e.g., $\alpha,\alpha,\alpha',\alpha'$-tetramethylxylylene diisocyanate); isocyanates; compounds formed by blocking these polyisocyanates by a phenol derivative, an oxime, and a caprolactam. These may be used singly or a combination of two or more.

A ratio of the polyisocyanate (3) is usually from 5/1 to 1/1, preferably from 4/1 to 1.2/1, and more preferably from 2.5/1 to 1.5/1, as an equivalent ratio of [NCO]/[OH] between an isocyanate group [NCO] and a hydroxyl group [OH] of a hydroxyl group-containing polyester. When [NCO]/[OH] exceeds 5, the low-temperature fixing property may get worse. In a case of using urea-modified polyester, the urea content in the ester becomes low when a molar ratio of [NCO] is less than 1, and hot offset resistance deteriorates.

The content of the polyisocyanate (3) in the isocyanate group-containing polyester prepolymer (A) ranges usually from 0.5 wt % to 40 wt %, preferably from 1 wt % to 30 wt %, and more preferably from 2 wt % to 20 wt %. If the content of the polyisocyanate compound is less than 0.5 wt %, the hot offset resistance deteriorates, and it is unfavorable from the viewpoint of compatibility of heat resistant preservability and low-temperature fixing property. On the other hand, if the content of the polyisocyanate compound exceeds 40 wt %, the low-temperature fixing property may get worse.

The number of isocyanate groups contained in one molecule of the isocyanate group-containing polyester prepolymer (A) is usually at least 1, preferably, an average of 1.5 to 3, and more preferably, an average of 1.8 to 2.5. If the isocyanate group per molecule is less than 1, then the molecular weight of the urea-modified polyester becomes low and the hot offset resistance may deteriorate.

Amines (B) include diamine (B1), trivalent or more polyamine (B2), amino alcohols (B3), amino mercaptans (B4), amino acids (B5), and the compounds (B6) of B1 to B5 in which their amino groups are blocked. Examples of the diamine (B1) include aromatic diamines (e.g., phenylene diamine, diethyl toluene diamine, and 4,4'-diaminodiphenyl methane); alicyclic diamines (e.g., 4,4'-diamino-3,3'-dimethyldicyclohexylmethane, diamine cyclohexane, and isophorone diamine); and aliphatic diamines (e.g., ethylene diamine, tetramethylene diamine, and hexamethylene diamine). Examples of the trivalent or more amine compounds (B2) include diethylene triamine and triethylene tetramine. Examples of the amino alcohols (B3) include ethanolamine and hydroxyethylaniline. Examples of the amino mercaptans (B4) include aminoethyl mercaptan and aminopropyl mercaptan. Examples of the amino acids (B5) include aminopropionic acid and aminocaproic acid. Examples of the compounds (B6), in which the amino groups of B1 to B5 are blocked, include ketimine compounds obtained from the amines of B1 to B5 and ketones (e.g., acetone, methyl ethyl ketone, and methyl isobutyl ketone), and oxazolidine compounds. The preferable amines among the amines (B) are B1 and a mixture of B1 with a small amount of B2.

A reaction inhibitor is used as required for crosslinking reaction between a polyester prepolymer (A) and amines (B) to obtain the modified polyester (i) and/or elongation reaction, thereby adjusting the molecular weight of the urea-modified polyester obtained. Examples of the reaction inhibitor include monoamines (e.g., diethylamine, dibutylamine, butylamine, and laurylamine), and compounds (ketimine compounds) in which the monoamines are blocked.

A ratio of amines (B) is usually 1/2 to 2/1, preferably 1.5/1 to 1/1.5, and more preferably 1.2/1 to 1/1.2 as an equivalent ratio of [NCO]/[NHx] between an isocyanate group [NCO] in the isocyanate group-containing polyester prepolymer (A) and an amine group [NHx] in the amines (B). When [NCO]/[NHx] exceeds 2 or is less than ½, the molecular weight of the urea-modified polyester (i) becomes smaller, resulting in deterioration in hot offset resistance.

An urethane bond may be contained together with an urea bond in the polyester (i) modified urea bond. A molar ratio of the urea bond content and the urethane bond content ranges usually from 100/0 to 10/90, preferably from 80/20 to 20/80, and more preferably from 60/40 to 30/70. If the molar ratio of the urea bond is less than 10%, the hot offset resistance may deteriorate.

The urea-modified polyester (i) can be made by these reactions. The urea-modified polyester (i) is manufactured by a one shot method and a prepolymer method. The weight-average molecular weight of the urea-modified polyester (i) is usually not less than 10,000, preferably 20,000 to 10,000,000, and more preferably 30,000 to 1,000,000. If the weight-average molecular weight is less than 10,000, the hot offset resistance deteriorates.

A number-average molecular weight of the urea-modified polyester (i) is not particularly limited when a unmodified polyester (ii) explained later is used, and the number-average molecular weight should be one which is easily obtained to get a weight-average molecular weight. When the urea-modified polyester (i) is used alone, the number-average molecular weight is usually 20,000 or less, preferably 1,000 to 10,000, and more preferably 2,000 to 8,000. When the number-average molecular weight exceeds 20,000, the low-temperature fixing property deteriorates and the glossiness also deteriorates when used for full-color apparatus.

The polyester (i) modified urea bond can be used alone, and also an unmodified polyester (ii) can be contained together with (i) as a binder resin component. By using (i) in combination with the unmodified polyester (ii), the low-temperature fixing property is improved and the glossiness is also improved when used for full-color apparatus, which is more preferable than a single use of (i). Examples of the unmodified polyester (ii) include polycondensation of polyol (1) and polycarboxylic acid (2), similarly to the polyester component of (i), and preferred compounds are also the same as (i). Further, the unmodified polyester (ii) can also include polyester that is modified using chemical bonds other than the urea bonds. It is preferable that at least parts of (i) and (ii) are compatible with each other, from viewpoint of low-temperature fixing property and hot offset resistance.

Therefore, polyester components of (i) and (ii) have preferably similar compositions. A weight ratio between (i) and (ii) when (ii) is contained is usually 5/95 to 80/20, preferably 5/95 to 30/70, more preferably 5/95 to 25/75, and particularly preferably 7/93 to 20/80. When the weight ratio of (i) to (ii) is less than 5%, the hot offset resistance deteriorates, and this becomes disadvantageous in respect of compatibility between heat resistant preservability and low-temperature fixing property.

The peak molecular weight of (ii) is usually 1,000 to 30,000, preferably 1,500 to 10,000, and more preferably 2,000 to 8,000. When the peak molecular weight is less than 1,000, heat resistant preservability deteriorates, and when it exceeds 30,000, low-temperature fixing property deteriorates. A hydroxyl value of (ii) is preferably 5 or more, more preferably 10 to 120, and particularly preferably 20 to 80. When the hydroxyl value is less than 5, it becomes disadvantageous in respect of compatibility between the heat resistant preservability and the low-temperature fixing property. An acid value of (ii) is preferably 1 to 30, and more preferably 5 to 20. By having the acid value tends to be easily negative electric.

A glass transition point ($T_g$) of the binder resin is from 50° C. to 70° C., and preferably from 55° C. to 65° C. If $T_g$ is less than 50° C., blocking when toner is stored under high temperature deteriorates, while if $T_g$ exceeds 70° C., the low temperature fixing property becomes insufficient. Under coexistence with urea-modified polyester resin, the toner tends to show better heat resistant preservability as compared with known polyester toner, even if the glass transition point is low. The temperature (TG') at which the storage elastic modulus of the binder resin at a measuring frequency of 20 Hz is 10000 dyne/cm$^2$ is preferably 100° C. or more, more preferably from 110° C. to 200° C. If the temperature (TG') is less than 100° C., then hot offset resistance may deteriorate. The temperature (Tη) at which the viscosity of the binder resin is 1000 poises at the measuring frequency of 20 Hz is preferably 180° C. or less, more preferably from 90° C. to 160° C. If the temperature (Tη) exceeds 180° C., the low temperature fixing property deteriorates. More specifically, TG' is preferably higher than Tη in terms of compatibility between the low temperature fixing property and the hot offset resistance. In other words, a difference between TG' and Tη (TG'−Tη) is preferably 0° C. or more, more preferably 10° C. or more, and particularly preferably 20° C. or more. The upper limit of the difference is not particularly defined. Moreover, in terms of compatibility between the heat resistant preservability and the low temperature fixing property, a difference between Tη and Tg is preferably from 0° C. to 100° C., more preferably from 10° C. to 90° C., and particularly preferably from 20° C. to 80° C.

The binder resin is manufactured by the following method.

At first, polyol (1) and polycarboxylic acid (2) is heated to 150° C. to 280° C. in the presence of a known esterification catalyst such as tetrabutoxytitanate and dibutyltin oxide, and by distilling water generated while pressure is reduced if required, and polyester having the hydroxyl group is obtained. Polyisocyanate (3) is reacted with the polyester at a temperature of 40° C. to 140° C. to obtain isocyanate group-containing prepolymer (A). The amine group (B) is further reacted with (A) at the temperature of 0° C. to 140° C. to obtain polyester (i) modified by urea bond. When (3) is reacted or (A) and (B) are reacted, a solvent can be used if necessary.

Examples of available solvent include those inactive to isocyanate, such as an aromatic solvent (e.g., toluene, and xylene); ketone group (e.g., acetone, methyl ethyl ketone, and methyl isobutyl ketone); ester group (e.g., ethyl acetate); amide group (e.g., dimethylformamide, and dimethylacetoamide); and ether group (e.g., tetrahydrofuran).

When polyester (ii) not modified by urea bond is used at the same time, the polyester (ii) is prepared using the same method as that of the polyester having hydroxyl group, and is dissolved in and mixed with the polyester (i).

The toner can be manufactured in the following method, but the method is not limited thereby.

The toner particles may be formed by reacting a dispersion of isocyanate group-containing prepolymer (A) with the amine group (B) in the aqueous medium, or previously manufactured urea-modified polyester (i) may be used. An example of the method of stably forming a dispersion of the urea-modified polyester (i) and the prepolymer (A) in the aqueous medium includes a method of adding a composition of toner materials formed of the urea-modified polyester (i) and the prepolymer (A) to the aqueous medium and dispersing it by shear force.

The prepolymer (A) and other toner compositions i.e., toner materials, such as a colorant, colorant master batch, a release agent, a charge control agent, and the unmodified polyester resin may be mixed upon formation of the dispersion in the aqueous medium. However, it is more preferred that the toner materials are previously mixed and then the mixture is added to the aqueous medium and dispersed. The other toner materials such as the colorant, the release agent, and the charge control agent are not necessarily mixed when particles are formed in the aqueous medium, and therefore, the other toner materials may be added to the aqueous medium after particles are formed. For example, particles without a colorant are formed and then a colorant can be added thereto in a known dyeing method.

As an aqueous medium, water may be used singly or in combination with water-soluble solvent. Examples of the water-soluble solvent include alcohol (e.g., methanol, isopropanol, and ethylene glycol), dimethyl formamide, tetrahydrofuran, cellosolves (e.g., methyl cellosolve), and lower ketones (e.g., acetone, methyl ethyl ketone).

The use amount of the aqueous medium for 100 parts by weight of the toner materials containing the urea-modified polyester (i) and the prepolymer (A) is usually 50 parts by weight to 2,000 parts by weight, preferably 100 parts by weight to 1,000 parts by weight. If the use amount is less than 50 parts by weight, the toner materials are poorly dispersed, and it is thereby impossible to obtain toner particles having a predetermined particle size. On the other hand, if the amount exceeds 2,000 parts by weight, this is economically inefficient.

Moreover, the dispersing agent can also be used according to need. It is preferable to use the dispersing agent because the particle-size distribution becomes sharp and dispersion is stabilized.

The dispersion method is not particularly limited, and it is possible to use known facilities of a low-speed shearing type, a high-speed shearing type, a friction type, a high-pressure jet type, and an ultrasonic type. Among these, the high-speed shearing type is preferred to obtain dispersed particles having a particle size ranging from 2 micrometers to 20 micrometers. When a high-speed shearing type dispersing machine is used, the number of revolutions is not particularly limited, and is usually from 1,000 revolutions per minute to 30,000 revolutions per minute, preferably from 5,000 revolutions per minute to 20,000 revolutions per minute. The dispersion time is not particularly limited and is usually from 0.1 minute to 5 minutes in a batch system. The dispersing temperature is usually from 0° C. to 150° C. (under a pressure), preferably from 40° C. to 98° C. Higher temperature is preferred because the dispersion containing the urea-modified polyester (i) and the prepolymer (A) has low viscosity and easily disperses.

The process of synthesizing the urea-modified polyester (i) from the prepolymer (A) may be in such a manner that the amines (B) are added before the toner materials are dispersed in the aqueous medium to cause reaction, or may be in such a manner that the amines (B) are added after the toner materials are dispersed in the aqueous medium to cause reaction from particle interface. In this case, urea-modified polyester is preferentially generated on the surface of manufactured toner, and thus, it is also possible to provide concentration gradient inside a particle.

In the reaction, it is preferable that the dispersing agent is used according to need.

The dispersing agent is particularly not limited, and accordingly selected as required. Examples of the dispersing agent include a surfactant, a poorly water-soluble inorganic dispersing agents, a polymer protective colloid. These may be used singly or in combination of two or more. Among these, the surfactant is preferable.

Examples of the surfactant include an anionic surfactant, a cationic surfactant, a nonionic surfactant, and a zwitterionic surfactant. Examples of the anionic surfactant include alkyl benzene sulfonate, α-olefin sulfonate, and ester phosphate. The anionic surfactant having a fluoroalkyl group is preferable.

Examples of the anionic surfactant having the fluoroalkyl group are fluoroalkyl carboxylic acids having a carbon number from 2 to 10 and their metal salts; disodium perfluorooctane sulfonyl glutamate, sodium 3-[ω-fluoroalkyl (C6 to C11) oxy]-1-alkyl (C3 to C4) sulfonate, sodium 3-[(ω-fluoroalkanoyl (C6 to C8)-N-ethylamino]-1-propane sulfonate, fluoroalkyl (C11 to C20) carboxylic acid and its metal salts; perfluoroalkyl carboxylic acid (C7 to C13) and its metal salts; perfluoroalkyl (C4 to C12) sulfonic acid and its metal salts, perfluorooctane sulfonic acid diethanolamide, N-propyl-N-(2-hydroxyethyl) perfluorooctane sulfonamide, perfluoroalkyl (C6 to C10) sulfonamide propyl trimethyl ammonium salts, perfluoroalkyl (C6 to C10)-N-ethylsulfonyl glycine salts, monoperfluoroalkyl (C6 to C16) ethyl phosphoric acid esters. Examples of product names of anionic surfactants having a fluoroalkyl group are SURFLON S-111, S-112, and S113 (manufactured by Asahi Glass Co., Ltd.), FLUORAD FC-93, FC-95, FC-98, and FC-129 (manufactured by Sumitomo 3M Co., Ltd.), UNIDINE DS-101 and DS-102 (manufactured by Daikin Industries, Ltd.), MEGAFACE F-110, F-120, F-113, F-191, F-812, and F-833 (manufactured by Dainippon Ink & Chemicals, Inc.), EKTOP EF-102, 103, 104, 105, 112, 123A, 123B, 306A, 501, 201, and 204 (manufactured by Tochem Products Co., Ltd.), and FTERGENT F-100 and F150 (manufactured by Neos Co., Ltd.).

Examples of the cationic surfactant include cationic surfactants of amine salts types and cationic surfactants of quaternary ammonium salt types. The cationic surfactants of amine salts types include such as alkyl amine salts, aminoalcohol fatty acid derivatives, polyamine fatty acid derivatives, and imidazoline. The cationic surfactants of quaternary ammonium salt types include such as alkyl trimethyl ammonium salts, dialkyl dimethyl ammonium salts, alkyl dimethyl benzyl ammonium salts, pyridinium salts, alkyl isoquinolinium salts, and benzethonium chloride. Among the cationic surfactants include aliphatic primary, secondary, or tertiary amine containing a fluoroalkyl group, aliphatic quaternary ammonium salt such as ammonium salt of perfluoroalkyl (C6-C10) sulfonamide propyl trimethyl; benzalkonium salts, benzethonium chloride, pyridinium salts, and imidazolinium salts. Trade names thereof are SURFLON S-121 (manufactured by Asahi Glass Co., Ltd.), FLUORAD FC-135 (manufactured by Sumitomo 3M Co., Ltd.), UNIDYNE DS-202 (manufactured by Daikin Industries, Ltd.), MEGAFACE F-150 and F-824 (manufactured by Dainippon Ink & Chemicals, Inc.), EKTOP EF-132 (manufactured by Tochem Products Co., Ltd.), and FTERGENT F-300 (manufactured by Neos Co., Ltd.), or the like.

Examples of the nonionic surfactant include such as fatty acid amide derivatives and polyhydric alcohol derivatives.

Example of the zwitterionic surfactants include such as alanine, dodecyl di(aminoethyl)glycine, di(octylaminoethyl) glycine, N-alkyl-N, and N-dimethyl ammonium betaine.

Example of the poorly water-soluble inorganic dispersing agents include such as calcium phosphate tribasic, calcium carbonate, titanium oxide, colloidal silica, and hydroxyapatite.

Examples of the high polymer protective colloid include acids, methacrylic monomers containing a hydroxyl group, vinyl alcohol or ethers with vinyl alcohol, amide compounds or their methylol compounds, chlorides, homopolymers or copolymers of nitrogen atom or of heterocyclic ring, polyoxyethylene compounds, cellulose group.

Examples of the acids include such as acrylic acid, methacrylic acid, α-cyanoacrylic acid, α-cyanomethacrylic acid, itaconic acid, crotonic acid, fumaric acid, maleic acid, or maleic anhydride.

Example of the (meth)acrylic monomers containing a hydroxyl group include such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro 2-hydroxypropyl acrylate, 3-chloro 2-hydroxypropyl methacrylate, diethylene glycol monoacrylic ester, diethylene glycol monomethacrylic ester, glycerol monoacrylic ester, glycerol monomethacrylic ester, N-methylol acrylamide, N-methylol methacrylamide.

Examples of the vinyl alcohol or ethers with vinyl alcohol include vinyl methyl ether, vinyl ethyl ether, vinyl propyl ether; or esters of compounds that contains a vinyl alcohol and a carboxyl group such as vinyl acetate, vinyl propionate, vinyl butyrate.

Examples of the amide compounds or their methylol compounds include acrylamide, methacrylamide, diacetone acrylamide or their methylol compounds.

Examples of the chlorides include such as chloride acrylate and chloride methacrylate.

Example of the homopolymers or copolymers of nitrogen atom or of heterocyclic ring include such as vinylpyridine, vinylpyrrolidone, vinylimidazole, and ethyleneimine.

Examples of the polyoxyethylene compound include such as polyoxyethylene, polyoxypropylene, polyoxyethylene alkyl amine, polyoxypropylene alkyl amine, polyoxyethylene alkyl amide, polyoxypropylene alkyl amide, polyoxyethylene nonyl phenyl ether, polyoxyethylene lauryl phenyl ether, polyoxyethylene stearyl phenyl ester, and polyoxyethylene nonyl phenyl ester.

Examples of the cellulose group include such as methyl cellulose, hydroxyethyl cellulose, and hydroxypropyl cellulose.

A dispersion stabilizer can be used for preparation of the dispersion as required. The dispersion stabilizer includes acids such as calcium phosphate salt and one soluble in alkali.

When the dispersion stabilizer is used, the calcium phosphate salt is dissolved by the acid such as hydrochloric acid, and then the calcium phosphate salt is removed from fine particles using a method of washing or a method of decomposing the dispersion stabilizer with enzyme.

A catalyst for the elongation reaction or the crosslinking reaction can be used for preparation of the dispersion. Examples of the catalyst include dibutyltin laurate and dioctyltin laurate.

Furthermore, to decrease the viscosity of the toner materials, a solvent in which urea-modified polyester (i) and prepolymer (A) are soluble can be used. It is preferred to use the solvent because the particle-size distribution becomes sharp. The solvent is preferably volatile because of easy removal.

Examples of the solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methylethyl ketone, and methylisobutyl ketone. These may be used singly or in combination of two or more. Among these, aromatic solvent such as toluene and xylene; and halogenated hydrocarbon such as methylene chloride, 1,2-dichloroethane, chloroform, and carbon tetrachloride are preferred, and the aromatic solvent such as toluene and xylene is more preferred. The use amount of solvent is usually 0 part to 300 parts for 100 parts of prepolymer (A), preferably 0 part to 100 parts, and more preferably 25 parts to 70 parts. When the solvent is used, the solvent is heated under normal pressure or reduced pressure after elongation and/or crosslinking reaction, and is removed.

An elongation and/or crosslinking reaction time is selected according to the reactivity of a combination of an isocyanate group structure of the prepolymer (A) and amines (B), and is usually 10 minutes to 40 hours, preferably 2 hours to 24 hours. The reaction temperature is usually from 0° C. to 150° C., preferably from 40° C. to 98° C. Moreover, a known catalyst can be used according to need. Specific examples of the catalyst are dibutyltin laurate and dioctyltin laurate.

To remove an organic solvent from an obtained emulsified dispersion, it is possible to use a method of gradually heating up the whole system and perfectly evaporating and removing an organic solvent in droplets. Alternatively, it is also possible to spray the emulsified dispersion in a dry atmosphere, perfectly remove water-insoluble organic solvent in droplets to form toner particles, and also evaporate and remove an aqueous dispersing agent. As the dry atmosphere in which the emulsified dispersion is sprayed, gas, especially, various types of airflows are generally used. More specifically, the gas is obtained by heating air, nitrogen, carbon dioxide, combustion gas, or the like, and the various types of airflows are obtained by heating a solvent to be used having the maximum boiling point to the boiling point or more. Targeted quality can be sufficiently obtained by a process using a spray dryer, a belt dryer, or a rotary kiln in a short time.

When the particle-size distribution upon dispersion of emulsified dispersion is broad and washing and drying processes are performed while keeping the particle-size distribution, the broad particle-size distribution is classified into desired particle-size distributions, so that the particle-size distributions can be put in order.

The classification is operated in the solution by a cyclone, decanter, or centrifugal separation, so that fine particle parts can be removed from the solution. The classification may also be operated after particles are obtained as powder after being dried, but the operation in the solution is preferred in terms of efficiency. Obtained unnecessary fine particles or coarse particles are returned again to the kneading process so that these particles can be used to form particles. In this case, fine particles or coarse particles may be wet.

It is preferable to remove the used dispersing agent from the dispersion solution as much as possible, but it is more preferable to perform the removal operation together with the classification operation.

The powder of toner obtained after being dried is mixed with heterogonous particles such as release-agent particles, charge-control-agent particles, fluidizing-agent particles, and colorant particles, and mechanical impacts are given to the mixed powder, to cause the particles to be solidified and melted on each surface of the toner particles to obtain composite particles. Thus, desorption of the heterogonous particles from the surfaces of the composite particles can be prevented.

Specific means include (1) a method of providing an impact to the mixture by blades rotating at high speed, and a method of inputting the mixture into a high-speed airflow, accelerating the airflow, (2) and impinging particles against each other or composite particles against an appropriate impinging plate. Devices include Ong Mill (manufactured by Hosokawa Micron Corp.), a device which is modified from I-Type Mill (manufactured by Nippon Pneumatic Mfg. Co., Ltd.) and reduces pulverizing air pressure, Hybridization System (manufactured by Nara Kikai Seisakusho), Cryptron System (manufactured by Kawasaki Heavy Industries, Ltd.), and an automatic mortar.

As colorants used for the toner, all dyes and pigments conventionally used as colorant for toner can be used. Examples thereof are carbon black, lamp black, iron black, ultramarine blue, nigrosine dye, aniline blue, phthalocyanine blue, phthalocyanine green, Hansa yellow G, rhodamine 6C lake, chalco-oil blue, chrome yellow, quinacridone red, benzidine yellow, and rose bengal, and these materials can be used singly or in combination.

To further provide magnetic property to the toner particle itself as required, magnetic components of iron oxides such as ferrite, magnetite, and maghemite; metal such as iron, cobalt, and Nickel; or alloys of these materials and other metals may be contained alone or in combination thereof in the toner particle. These components can be also used as colorant components and also used in combination with others.

The number-average particle size of the colorant in the toner is 0.5 micrometer or less, preferably 0.4 micrometer or less, more preferably 0.3 micrometer or less. If the number-average particle size of the colorant in the toner is 0.5 micrometer or more, then dispersion of pigments does not reach an adequate level and preferable transparency cannot sometimes be obtained. On the other hand, the number-average particle size of colorant of a fine particle size smaller than 0.1 micrometer is sufficiently smaller than a half-wavelength of the visible light, and thus, it is considered that the colorant does not affect reflection and absorption properties of light. Therefore, the particles of colorant having a size less than 0.1 micrometer are useful for better color reproducibility and transparency of an overhead projector (OHP) sheet with a fixed image thereon. On the other hand, if there are many colorants having a particle size larger than 0.5 micrometer, transmission of incident light is thereby blocked or the incident light is caused to scatter, and brightness and vividness of a projected image of the OHP sheet thereby tend to lower. Furthermore, if there are many colorants having a particle size larger than 0.5 micrometer, it is not preferred because the colorants are desorbed from the surface of the toner particle, which easily causes various troubles such as fogging, drum contamination, defective cleaning. Particularly, the number of colorants having a particle size larger than 0.7 micrometer is preferably 10 number % or less of the all colorants, more preferably 5 number % or less.

The colorants and part of or the whole of the binder resin are previously applied with a moisturizing agent and kneaded, and the binder resin and the colorants thereby sufficiently adhere to each other in the initial stage. Thereafter, the colorants are effectively dispersed on a toner particle in a toner manufacturing process, the dispersed particle size of the colorant becomes smaller, and further more transparency can thereby be obtained.

As the binder resin used for kneading in the previous stage, the resin group shown as the binder resin for toner can be used as it is, but the binder resin is not limited thereby.

A specific method of previously kneading the mixture of the binder resin and the colorants with the moisturizing agent includes a method of mixing the binder resin, the colorants, and the moisturizing agent by a blender such as a Henschel mixer, and kneading the mixture by a kneader with two rolls or three rolls at a temperature lower than a melting temperature of the binder resin, to obtain a sample.

As the moisturizing agent, ordinary agents can be used in view of melting property of the binder resin and applying capability with the colorants, and especially, organic solvent such as acetone, toluene, and butanone and water are preferred in terms of dispersion capability of the colorants. Among these materials, water is more preferably used from the view point of environmental concerns and maintenance of dispersion stability of colorants in the following toner manufacturing process.

According to the method, the particle size of the colorant particles contained in the obtained toner becomes small and homogeneity in the dispersed state of the particles increases. Thus, the color reproducibility of a projected image by the OHP becomes further better.

In addition, it is preferable that a release agent is contained together with the binder resin and the colorants in the toner.

The release agents are not particularly limited, and therefore can be suitably selected from among those generally known as a material for the release agents. For example, the release agent includes polyolefin wax (e.g., polyethylene wax and polypropylene wax); long chain hydrocarbon (e.g., paraffin wax and Sasol Wax); and carbonyl group-containing wax. Preferred one of these is carbonyl group-containing wax.

Examples of carbonyl group-containing wax include polyalkanoic acid ester (e.g., carnauba wax, montan wax, trimethylolpropane tribehenate, pentaerythritol tetrabehenate, pentaerythritol diacetate dibehenate, glycerin tribehenate, 1,18-octadecanediol distearate); polyalkanol ester (e.g., trimellitic acid tristearyl, distearyl maleate); polyalkanoic acid amide (e.g., etylenediamine dibehenylamide); polyalkylamide (e.g., tristearylamide trimellitate); and dialkyl ketone (e.g., distearyl ketone). Among these, preferred one is polyalkanoic acid ester.

The melting point of these release agents is usually from 40° C. to 160° C., preferably from 50° C. to 120° C., and more preferably from 60° C. to 90° C. The release agents with a melting point of lower than 40° C. may adversely affect the heat-resistance storageability. In contrast, the release agents with a melting point of higher than 160° C. may often cause cold offset upon image fixing at low temperatures. The melt viscosity of the release agents is preferably from 5 cps to 1000 cps, and more preferably from 10 cps to 100 cps at a temperature which is 20° C. higher than its melting point. The release agents with a melt viscosity of more than 1000 cps may not satisfactorily contribute to improved hot offset resistance and image-fixing properties at low temperatures. A content of the release agents in the toner is usually from 0 wt % to 40 wt %, and preferably from 3 wt % to 30 wt %.

To speed up the charge amount of toner and its start-up, a charge control agent may be contained in the toner according to need. If a colored material is used as the charge control agent, the color is caused to change, and thus, any material close to monochrome and white color is preferred.

The charge control agents are not particularly limited, and therefore can be suitably selected from among those generally known as a material for the charge control agents. For example, the charge control agents include triphenylmethane dyes, chelate molybdate pigment, rhodamine dyes, alkoxy amine, quaternary ammonium salt (including fluorine modified quaternary ammonium salt), alkylamide, phosphorus alone or compounds thereof, tungsten alone or compounds thereof, fluorine-based active agents, salicylic acid metal salts, and metal salts of salicylic acid derivatives.

The charge control agent can be used product names. Examples of the charge control agents include Bontron P-51 as quaternary ammonium salts, E-82 as oxynaphthoic acid type metal complex, E-84 as salicylic acid metal complex, E-89 as phenol type condensate (these are manufactured by Orient Chemical Industries, Ltd.), TP-302 and TP-415 as quaternary ammonium salt molybdenum complexes (manufactured by Hodogaya Chemical Industries, Ltd.), Copy Charge PSY VP2038 as quaternary ammonium salt and Copy Charge NX VP434 as quaternary ammonium salt (these are manufactured by Hoechst Co., Ltd.), LRA-901 and LR-147 as boron complex (manufactured by Japan Carlit Co., Ltd.), quinacridone, azo type pigments, and polymer compounds having a functional group such as a sulfonic acid group, a carboxyl group, and a quaternary ammonium salt group.

The additive amount of the charge control agent is different depending on the type of binder resins, presence or absence of additives, and a method of manufacturing toner including a dispersion method, and hence, it is not uniquely limited. However, the charge control agent is used preferably in a range from 0.1 part by weight to 10 parts by weight, and more preferably from 0.2 part by weight to 5 parts by weight, per 100 parts by weight of the binder resin. If the additive content exceeds 10 parts by weight, the toner is charged too highly, which may cause effects of the charge control agent to be decreased, electrostatic attracting force with a developing roller to be increased, fluidity of the developer to be lowered, and image density to be reduced. These charge control agent can be melted and kneaded with the master batch and the resin and then the mixture can be dissolved and dispersed, or may be directly added to organic solvent at a time of dissolution and dispersion, or may be solidified on the toner surface after toner particles are formed.

When the toner materials are dispersed in the aqueous medium during the toner manufacturing process, resin fine particles may be added to the toner materials to mainly stabilize the dispersion.

The resin fine particles may be of any resin selected from thermoplastic resins and thermosetting resins, if an aqueous dispersion may be formed from the resin fine particles. Examples of the resins include vinyl resins, polyurethane resins, epoxy resins, polyester resins, polyamide resins, polyimide resins, silicon resins, phenol resins, melamine resins, urea resins, aniline resins, ionomer resins, and polycarbonate resins. These resins can be used singly or in combination of two or more. Among these, vinyl resins, polyurethane resins, epoxy resins, polyester resins, and combinations thereof are preferred, since aqueous dispersions of resin spherical fine particles can be easily obtained.

Examples of the vinyl resins include polymers in which vinyl monomer is singly polymerized or copolymerized with other monomers, such as styrene-methacrylic ester copolymers, styrene-butadiene copolymers, methacrylic acid-acrylic ester copolymers, styrene-acrylonitrile copolymers, styrene-maleic acid anhydride copolymers, and styrene-methacrylic acid copolymers.

Inorganic fine particles are preferably used as an external additive to facilitate fluidity, developing performance, and chargeability of toner particles.

Specific examples of the inorganic particles include silica, alumina, titanium oxide, barium titanate, magnesium titanate, calcium titanate, strontium titanate, zinc oxide, tin oxide, silica sand, clay, mica, wollastonite, diatomite, chromium oxide, cerium oxide, red iron oxide, antimony trioxide, magnesium oxide, zirconium oxide, barium sulfate, barium carbonate, calcium carbonate, silicon carbide, and silicon nitride.

The inorganic fine particle has preferably a primary particle diameter of 5 nanometers to 2 micrometers. In particular, the primary particle diameter is preferably 5 nanometers to 500 nanometers. A specific surface area by the BET method is preferably 20 $m^2/g$ to 500 $m^2/g$. The use ratio of the inorganic fine particles is preferably 0.01 wt % to 5 wt % in toner particles, and more preferably 0.01 wt % to 2.0 wt %.

In addition, there are polymer type fine particles, for example, polystyrene, ester methacrylate and ester acrylate copolymers, which are prepared by soap-free emulsion polymerization, suspension polymerization, or dispersion polymerization; and a polycondensation type such as silicone, benzoguanamine, and nylon; and polymer particles prepared from thermosetting resin.

The toner may be added to fluidizing agents. The fluidizing agents are subjected to surface treatment to increase hydrophobicity, so that deterioration of fluid characteristics and charging characteristics can be prevented even under high humidity. Examples of the preferred fluidizing agents include such as a silane coupling agent, a silylating agent, a silane coupling agent having a fluorinated alkyl group, an organic titanate type coupling agent, an aluminum type coupling agent, silicone oil, and modified silicon oil as preferred surface treatment agent.

Examples of a cleaning improving agent to remove a developer remaining on a photoconductor and an intermediate transfer unit after an image is transferred therefrom include fatty acid metal salt such as zinc stearate, calcium stearate, and stearic acid; and polymer fine particles such as polymethyl methacrylate fine particles and polystyrene fine particles manufactured by soap-free emulsion polymerization or the like. The polymer fine particles have comparatively narrow particle-size distribution, and particles having a volume-average particle size of 0.01 micrometer to 1 micrometer are preferable.

By using such as toner particles, a high-quality toner image excellent in development stability can be formed.

The image forming apparatus can use the toner by a polymerization method suitable to obtain the high-quality images and also use amorphous toner obtained by a pulverizing method, which can greatly extend the life of the apparatus. Materials containing the toner due to the pulverizing method are not particularly limited, and thus, the materials generally used for toner for electro-photography can be used.

Examples of binder resins used for the toner obtained by using the pulverizing method include styrenes such as polystyrene, poly-p-chlorostyrene, and polyvinyltoluene, and substituted homopolymers thereof; styrene copolymers such as styrene-p-chlorostyrene copolymer, styrene-propylene copolymer, styrene-vinyl toluene copolymer, styrene-vinyl naphthalene copolymer, styrene-acrylic acid methyl copolymer, styrene-acrylic acid ethyl copolymer, styrene-acrylic acid butyl copolymer, styrene-acrylic acid octyl copolymer, styrene-methacrylic acid methyl copolymer, styrene-methacrylic acid ethyl copolymer, styrene-methacrylic acid butyl copolymer, styrene-α-chloromethacrylic acid methyl copolymer, styrene-acrylonitrile copolymer, styrene-vinyl methyl ketone copolymer, styrene-butadiene copolymer, styrene-isoprene copolymer, and styrene-maleic acid copolymer; acrylic acid ester homopolymers and copolymers thereof such as polymethyl acrylate, polybutyl acrylate, polymethyl methacrylate, polybutyl methacrylate; polyvinyl derivatives such as polyvinyl chloride, and polyvinyl acetate; polyester polymer, polyurethane polymer, polyamide polymer, polyimide polymer, polyol polymer, epoxy polymer, terpene polymer, fatty series or alicyclic hydrocarbon resin, and aromatic petroleum resin. These materials can be used singly or in combination of two or more. At least one selected from among styrene-acrylic acid copolymers, polyester resins, and polyol resins is more preferred in terms of electrical properties and cost. Polyester resins and/or polyol resins are more preferably used as one having excellent fixing capability.

The toner obtained by using the pulverizing method is formed simply by being subjected to the following processes in which the colorant components, the wax components, and the charge controlling components are mixed together with these resin components as required, the mixture is kneaded at a temperature near or less than the melting temperature of the resin components, the kneaded mixture is cooled down, and then it reaches a pulverizing/classifying process. The external additives may be added thereto and mixed according to need.

The developing device may use a dry developing method and a wet developing method, or may be a monochrome developing device or a multicolor developing device. For example, a preferred example of the developing device is one including a stirrer that frictionally stirs the toner or the developer to be charged and a rotatable magnet roller.

The toner and the carrier are mixed and stirred in the developing device, the toner is charged due to friction during the stirring, the charged toner is held as toner chains on the surface of the rotating magnet roller to form magnetic brushes. Because the magnet roller is arranged near the image carrier (photoconductor), part of the toner that forms the magnetic brushes formed on the surface of the magnet roller moves to the surface of the image carrier by the electrical attraction. Consequently, the electrostatic latent image is developed with the toner and a toner visible image is thereby formed on the surface of the image carrier.

The developer accommodated in the developing device is a developer containing toner; however, the developer may be a one-component developer or a two-component developer.

The transfer process is a process of transferring the visible image to a recording medium. A preferred transfer process is a mode of primarily transferring the visible image to the intermediate transfer unit and secondarily transferring the visible image to the recording medium. And a more preferred transfer process is a mode using toner of two or more colors preferably full-color toner, and including a primary transfer process for transferring the visible image to the intermediate transfer unit to form a composite transferred image and a secondary transfer process for transferring the composite transferred image to the recording medium.

The transfer of the visible image can be implemented by charging the image carrier using the charger, and the transfer can be performed by the transfer unit. A preferred transfer unit is a mode including a primary transfer unit that transfers the visible image to the intermediate transfer unit to form a composite transferred image and a secondary transfer unit that transfers the composite transferred image to the recording medium.

The intermediate transfer unit is not particularly limited and therefore can be suitably selected from among known ones depending on the application. A preferred example of the intermediate transfer unit is a transfer belt.

The photoconductor can be an intermediate transfer unit used in an intermediate transfer system in which each toner image formed on a photoconductor is primarily transferred and superimposed on one after another, and the toner images are further transferred onto a transfer material.

The intermediate transfer unit has preferably conductive properties of volume resistivity of $10^5\Omega\cdot$cm to $10^{11}\Omega\cdot$cm. If the surface resistivity is below $10^5$ $\Omega/cm^2$, an electrical discharge may be produced upon transfer of a toner image from the photoconductor onto the intermediate transfer unit and so-called "transfer dust" may occur upon the transfer, and thus the toner image blurs due to the transfer dust. If it is above $10^{11}$ $\Omega/cm^2$, after the toner image is transferred from the intermediate transfer unit onto a transfer material, the opposite charge to that of the toner image remains on the intermediate transfer unit, and may appear on the next image as an afterimage.

A belt-shaped or cylindrical plastic can be used as the intermediate transfer unit. The plastic is obtained by kneading singly or in combination of conductive particles, such as metal oxide including tin oxide and indium oxide and carbon black, or of conductive polymer with thermoplastic resin, and subjecting the kneaded materials to extrusion molding. In addition to this, an intermediate transfer unit on an endless belt can also be obtained by adding the conductive particles or the conductive polymer to a resin solution containing monomers and oligomers having thermal crosslinking reactivity if necessary, and subjecting the mixed resin solution to centrifugal molding while being heated.

When the surface layer is to be provided on the intermediate transfer unit, a conductive substance is used in combination of any required composition, other than the charge transport material, of the materials used for the surface layer of the photoconductor, and the resistivity thereof is controlled. Thus, the obtained conductive substance can be used for the surface layer.

The transfer unit (primary transfer unit and secondary transfer unit) preferably includes at least a transfer device that charges the transfer unit so as to separate the visible image formed on the image carrier from the image carrier to the recording medium. The transfer unit may be provided with one or with two or more units. Examples of the transfer device include a corona discharger using corona discharging, a transfer belt, a transfer roller, a pressure transfer roller, and an adhesive transfer device.

The recording medium is not particularly limited and therefore can be suitably selected from among known recording media (recoding paper).

The protecting-layer forming process is a process of applying the protecting agent according to the present invention to the surface of the image carrier after the image is transferred to the recording medium, to form the protecting layer.

The protecting-layer forming device according to the present invention can be used as the protecting-layer forming unit.

The fixing process is a process of fixing the visible image on the recording medium using the fixing unit, and may be performed each time toner of each color is transferred to the recording medium or may be performed at a time when toners of colors are superimposed on each other.

The fixing unit is not particularly limited and therefore can be suitably selected according to the application, however, a known heating/pressing unit is more preferred. Examples of the heating/pressing unit include a combination of two such as a heating roller and a pressing roller, and a combination of three such as a heating roller, a pressing roller, and an endless belt.

Preferable heating in the heating/pressing unit is generally in a range of 80° C. to 200° C.

In the present invention, for example, a known optical fixing device may be used together with the fixing process and the fixing unit, or may be used instead of them according to the application.

The neutralizing process is a process of applying a neutralizing bias to the image carrier to perform neutralizing, which can be appropriately performed by the neutralizing unit.

The neutralizing unit is not particularly limited and therefore can be suitably selected from among known neutralizing units if the neutralizing unit can apply a neutralizing bias to the image carrier. A neutralizing lamp is a preferred example of the neutralizing unit.

The cleaning process is a process of removing toner for electrophotography remaining on the image carrier, which is appropriately performed by the cleaning unit.

The cleaning unit is preferably provided on the downstream side of the transfer unit and on the upstream side of the protecting-layer forming unit.

The cleaning unit is not particularly limited and therefore can be suitably selected from among known cleaners if the cleaner can remove the electrophotographic toner from the image carrier. Preferred examples of the cleaning unit include a magnetic brush cleaner, an electrostatic brush cleaner, a magnet roller cleaner, a blade cleaner, a brush cleaner, and a web cleaner.

The recycling process is a process of causing the developing unit to recycle the toner removed at the cleaning process, which is appropriately performed by the recycling unit.

The recycling unit is not particularly limited, and, therefore, examples thereof include known conveying units.

The control process is a process of controlling the processes, which is appropriately performed by the control unit.

The control unit is not particularly limited and therefore can be suitably selected according to the application if the control unit can control each movement of the units. Examples of the control unit include devices such as a sequencer and a computer.

Figure 2:
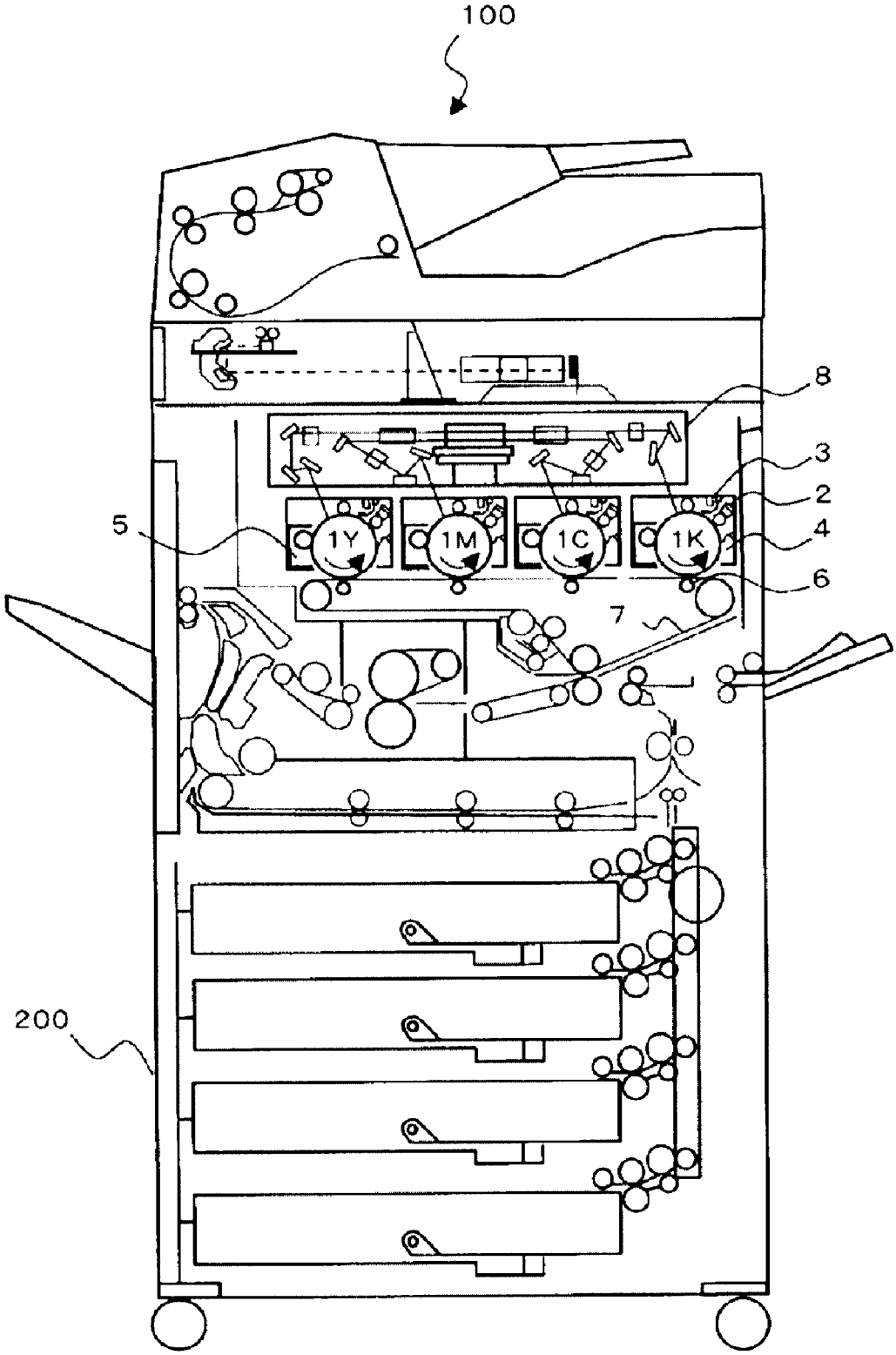
FIG. 2 is a schematic of one example of an image forming apparatus that includes the protecting-layer forming device.

FIG. 2 is a schematic of one example of the image forming apparatus that includes the protecting-layer forming device according to the present invention.

In FIG. 2, reference numeral 1 represents a photoconductor drum which is the image carrier, 2 the protecting-layer forming device, 3 a charger, 4 a cleaning device, 5 a developing device, 6 a transfer device (or transfer roller), 7 a transfer belt which is an intermediate transfer unit, 8 a latent-image forming device, 100 a copier as the image forming apparatus, 200 a paper feed mechanism, and reference symbol L represents an exposure light. Furthermore, symbols Y, M, C, and K represent colors respectively used for development, and correspond to yellow, magenta, cyan, and black respectively.

Arranged around each of the drum-shaped image carriers 1Y, 1M, 1C, and 1K are the protecting-layer forming device 2, the charger 3, the latent-image forming device 8, the developing device 5, the transfer device 6, and the cleaning device 4. The image formation is performed in the following operations.

A series of processes to form an image is explained below using a negative-positive process.

The image carrier such as an organic photo conductor (OPC) having an organic photoconductive layer is neutralized by a neutralizing lamp (not shown), and uniformly charged to negative by the charger 3 having a charging unit.

When the image carrier is charged by the charger 3, a certain amount of voltage appropriate for charging of the image carrier 1Y, 1M, 1C, and 1K to a desired potential or a charging voltage obtained by superimposing AC voltage on the voltage is applied from a voltage applying mechanism (not shown) to the charging unit.

The charged image carriers 1Y, 1M, 1C, and 1K are radiated with a laser beam L emitted by the latent-image forming device 8 such as a plurality of laser optical system, to form a latent image thereon (the absolute value of the potential at an exposed portion is lower than the absolute value of the potential at a non-exposed portion).

The laser beam is emitted from a semiconductor laser, and scans the surface of the image carriers 1Y, 1M, 1C, and 1K in the direction of the rotating axis of the image carrier by a polygon mirror rotating at high speed.

The latent image formed in the above manner is developed by a developer formed of toner particles or formed of a mixture of toner particles and carrier particles to form a visible image or a toner image. The developing device 5 includes a developing sleeve which serves as a developer carrier to supply the developer.

When the latent image is to be developed, an appropriate amount of voltage or a developing bias obtained by superimposing AC voltage on the voltage is applied from the voltage applying mechanism (not shown) to the developing sleeve. Each of the toner images formed on the image carriers 1Y, 1M, 1C, and 1K corresponding to the colors is transferred to the intermediate transfer unit 7 by the transfer device 6, and further transferred to a recording medium such as a sheet of paper fed from the paper feed mechanism 200.

At this time, it is preferred to apply a potential having a reverse polarity to the polarity of the charged toner, as a transfer bias, to the transfer device 6. Thereafter, the toner image is separated from the image carrier to be transferred to the intermediate transfer unit 7.

The toner particles remaining on the image carrier are collected by the cleaning unit into a toner collecting chamber in the cleaning device 4.

The image forming apparatus may be configured to arrange a plurality of the developing devices, sequentially form a plurality of toner images of different colors by the developing devices, sequentially transfer the formed toner images to a transfer material so as to be superimposed on each other, and send the toner image to a fixing mechanism, where the toner image is thermally fixed on the transfer material. Alternatively, the image forming apparatus may also be configured to form a plurality of toner images in the same manner as above, temporarily transfer the toner images sequentially to an intermediate transfer unit so as to be superimposed on each other, collectively transfer the toner image to a recording medium such as paper, and then fix the toner image thereon in the above manner.

The charger 3 is preferably arranged in contact with or close to the surface of the image carrier. With this feature, the amount of ozone produced upon charging can largely be suppressed as compared with that of a corona discharger so-called corotron or scorotron using an electrical-discharge wire.

In the charger that causes a charging unit to be in contact with or close to the surface of the image carrier and to charge the surface thereof, electrical discharge is performed in an area close to the surface thereof as explained above, and thus electrical stress to the image carrier tends to increase. However, by using the protecting-layer forming device that uses the protecting agent according to the present invention, the image carrier can be maintained over a long period of time without degradation. Thus, it is possible to largely suppress variation of images over time or variation of images due to the use environment and ensure stable image quality.

The image forming apparatus according to the present invention has a wider tolerance to variation in the surface state of the image carrier, especially to a presence of a low resistance portion, and highly suppresses variation in the charging performance to the image carrier. Therefore, by using also the above-mentioned toner, the image forming apparatus can stably form extremely high-quality images over a long period of time.

The process cartridge according to the present invention includes at least the image carrier and the protecting-layer forming device according to the present invention, and further includes other units as required, such as the charger (charging unit), the exposure unit, the developing unit, the transfer unit, the cleaning unit, and the neutralizing unit.

The process cartridge according to the present invention can be detachably attached to various types of electrophotographic devices, and it is preferable that the process cartridge is detachably attached to the image forming apparatus according to the present invention.

Figure 3:
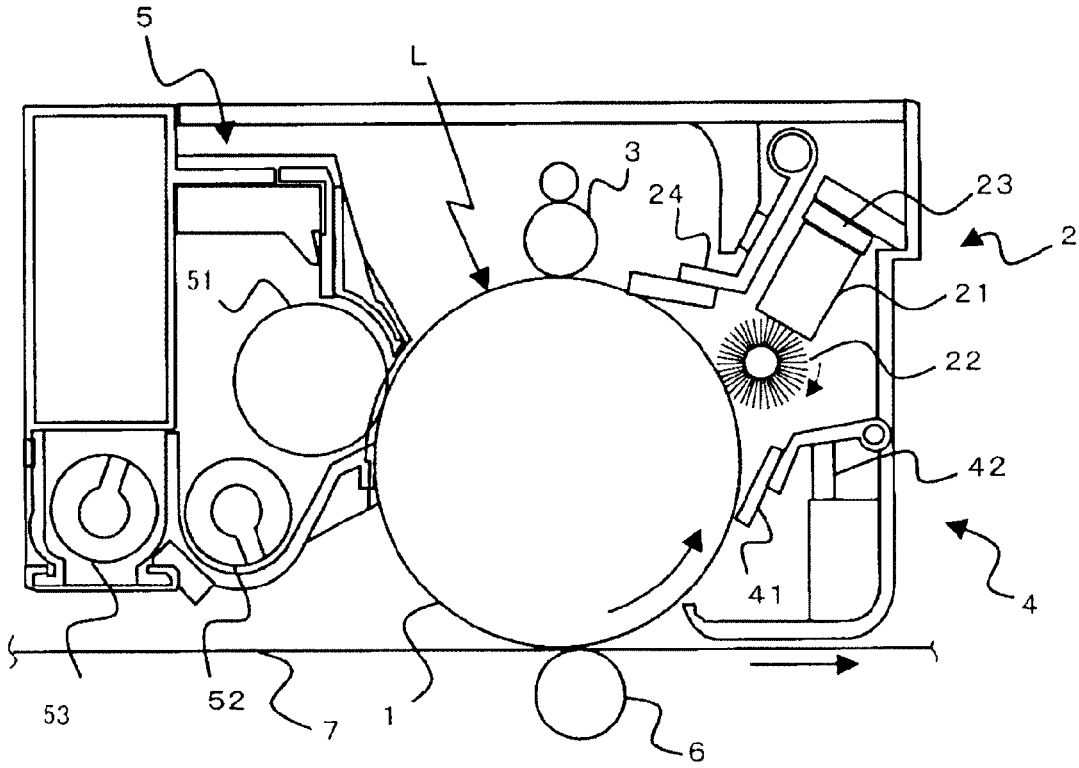
FIG. 3 is a schematic of one example of a process cartridge using the protecting-layer forming device.

FIG. 3 is a schematic of one example of the process cartridge using the protecting-layer forming device according to the present invention.

In FIG. 3, reference numeral 21 represents the protecting agent for the image carrier (hereinafter, "protecting agent 21"), 22 the protecting-agent supplying unit, 23 the pressing-force imparting unit, 24 the protecting-layer forming unit, 41 the cleaning unit, 42 the cleaning-unit pressing unit, 51 a developing roller, and 52 and 53 stirring/conveying rollers. The other reference numerals in FIG. 3 represent the same as these of FIG. 1 and FIG. 2.

In the process cartridge, the protecting-layer forming device 2 is arranged facing the photoconductor drum 1 which is the image carrier 1. The protecting-layer forming device 2 includes the protecting agent 21, the protecting-agent supplying unit 22, the pressing-force imparting unit 23, and the protecting-layer forming unit 24.

The protecting agent and toner components partly degraded after the transfer process is performed remain on the surface of the image carrier 1, but the residues on the surface are removed and cleaned by the cleaning unit 41.

In FIG. 3, the cleaning unit comes in contact with the surface of the image carrier at an angle so as to be contacted in the counter direction (leading type) with respect to the surface.

The residual toner and the degraded protecting agent are removed from the surface of the image carrier by the cleaning mechanism, the protecting agent 21 is supplied to the surface of the cleaned image carrier from the protecting-agent supplying unit 22, and a film-like protecting layer is formed thereon by the protecting-layer forming unit 24. The protecting agent used in the present invention has more excellent adsorption capability. Therefore, if this protecting agent is applied to a portion of the surface of the image carrier which becomes highly hydrophilic due to the electrical stress, large electrical stress is temporarily applied to the portion. However, even if the surface of the image carrier thereby starts degradation, the adsorption of the protecting agent allows prevention of the progress of degradation in the image carrier itself.

An electrostatic latent image is formed on the image carrier 1 with the protecting layer formed thereon in the above manner, using exposure light L such as laser after the image carrier is charged, the latent image is developed by the developing device 5 to be visualized, and the visualized image is transferred to the intermediate transfer unit 7 (or recording medium) by a device such as the transfer roller 6 provided outside the process cartridge.

As explained above, the process cartridge according to the present invention has a wider tolerance to variation in the surface state of the image carrier, especially to a presence of a low resistance portion, and highly suppresses variation in the charging performance to the image carrier. Therefore, by using also the above-mentioned toner, extremely high-quality images can be stably formed over a long period of time.

Example 1

Although examples of the present invention are explained below, the present invention is not limited by these examples.

Table 1 shows formulae of row materials of examples 1 to 20 according to the present invention.

Table 2 shows formulae of row materials of comparative examples 1 to 6 according to the present invention.

In both tables, material name abbreviations are as follows.

FRW: Fisher Tropsch wax

IPW: Isoparaffin wax

MCW: Microcrystalline wax

NPW: Normal paraffin wax

D-G: D-glucose dehydration-condensation product (average number of glucoses=90)

PMM: Polymethyl methacrylate (average molecular weight=1500)

MSG: Glyceryl monostearate

Preparation of Protecting Agent 1 for Image Carrier

The composition of protecting agent Formula 1 shown in table 1 was put into a glass container with a lid, and melted and dispersed while being stirred by a hot stirrer in which temperature was controlled to 160° C.

The melted composition of which particles were dispersed, due to protecting agent formula 1, was poured into an aluminum-made die having previously been heated to 110° C. so as to be filled therewith. More specifically, the die had inner dimensions of 12 mm×8 mm×350 mm. The composition was cooled down to 40° C. in room-temperature atmosphere, and then the composition was reheated up to 45° C. in a temperature-controlled bath in which the temperature was set and was held for 15 minutes at the same temperature, and thereafter, the composition was cooled down to the room temperature.

After cooled down, a solid matter made by the protecting agent formula 1 was removed from the die, and was cut to prepare a mold with 7 mm×8 mm×310 mm. The mold is made to adhere to a metal-made support with a double-stick tape, and the protecting agent 1 was prepared.

Examples 2 to 20 and Comparative Examples 1 to 6

Preparation of Protecting Agents 2 to 26 for Image Carrier

Table 3 is a list of preparation conditions of protecting agents. It is noted that endothermic peak temperatures indicate measured values obtained by being measured after each protecting agent is prepared.

The configuration according to the example 1 was not changed except for a row material, a melting temperature, a die preheating temperature, and cooling conditions as described in the table 1 to the table 3, and protecting agents 2 to 26 for the image carrier were thereby prepared.

Each endothermic peak temperature of the obtained protecting agents for the image carrier was measured in the following manner. The results are given to the table 3.

<Measurement of Endothermic Peak Temperature>

Each endothermic peak of the protecting agents was measured by using Differential Scanning Calorimeter (DSC-60, manufactured by Shimadzu Corp.).

A sample was obtained by partially scraping the protecting agent to weigh it on a scale to obtain about 10 milligrams. And the sample was put into an aluminum container with a lid (sample pan) to be sealed for use. The measurement was implemented by collecting a differential thermal profile upon temperature rise, measuring an endothermic peak temperature, and determining the measured endothermic peak temperature as a measured value.

TABLE 1

| Example | Protecting agent | Organic compound having melting property (A) | | | | | Organic compound particles having thermal decomposition property (B) | | | Volume ratio of | Other blending components | |
|---|---|---|---|---|---|---|---|---|---|---|---|---|
| | | Material | Mixing ratio | Mw | Penetration | Blending amount (parts) | Name | Average particle size | Penetration | (A)/(B) | Name | Penetration |
| 1 | 1 | FRW/IPW | 40:60 | 600 | 15 | 75 | D-G | 15 | 25 | 84/16 | MSG | 0.25 |
| 2 | 2 | FRW/IPW | 40:60 | 600 | 15 | 75 | Imide resin | 10 | 25 | 82/12 | MSG | 0.25 |
| 3 | 3 | FRW/IPW | 40:60 | 600 | 15 | 75 | Silicone rubber | 7 | 25 | 76/24 | — | 0 |
| 4 | 4 | FRW/MCW | 35:65 | 650 | 12 | 75 | Imide resin | 10 | 25 | 82/18 | MSG | 0.25 |
| 5 | 5 | FRW/IPW | 40:60 | 600 | 15 | 98 | D-G | 15 | 2 | 99/1 | MSG | 0.02 |
| 6 | 6 | FRW/IPW | 40:60 | 600 | 15 | 36 | D-G | 15 | 64 | 50/50 | MSG | 0.64 |
| 7 | 7 | FRW/IPW | 23:77 | 520 | 30 | 75 | D-G | 15 | 25 | 84/16 | MSG | 0.25 |
| 8 | 8 | FRW/IPW | 75:25 | 780 | 3 | 75 | D-G | 15 | 25 | 84/16 | MSG | 0.25 |
| 9 | 9 | FRW/IPW | 40:60 | 600 | 15 | 75 | D-G | 20 | 25 | 84/16 | MSG | 0.25 |
| 10 | 10 | FRW/IPW | 40:60 | 600 | 15 | 75 | D-G | 2 | 25 | 84/16 | MSG | 0.25 |
| 11 | 11 | FRW/IPW | 40:60 | 600 | 15 | 75 | D-G | 15 | 25 | 84/16 | MSG | 1.25 |
| 12 | 12 | FRW/IPW | 40:60 | 600 | 15 | 75 | D-G | 15 | 25 | 84/16 | MSG | 0.03 |
| 13 | 13 | FRW/IPW | 40:60 | 600 | 15 | 75 | D-G | 15 | 25 | 84/16 | MSG | 1.5 |
| 14 | 14 | FRW/IPW | 40:60 | 600 | 15 | 75 | D-G | 15 | 25 | 84/16 | MSG | 0.02 |
| 15 | 15 | FRW/IPW | 40:60 | 800 | 7 | 75 | D-G | 15 | 25 | 84/16 | MSG | 0.25 |
| 16 | 16 | FRW/IPW | 40:60 | 450 | 25 | 75 | D-G | 15 | 25 | 84/16 | MSG | 0.25 |
| 17 | 17 | FRW/IPW | 40:60 | 900 | 4 | 75 | D-G | 15 | 25 | 84/16 | MSG | 0.25 |
| 18 | 18 | FRW/IPW | 40:60 | 300 | 15 | 75 | D-G | 15 | 25 | 84/16 | MSG | 0.25 |
| 19 | 19 | FRW/NPW | 40:60 | 600 | 10 | 75 | D-G | 15 | 25 | 84/16 | — | 0 |
| 20 | 20 | FRW/IPW | 40:60 | 600 | 15 | 75 | PMM particles | 3 | 25 | 80/20 | — | 0 |

TABLE 2

| Example | Protecting agent | Organic compound having melting property (A) | | | | | Organic compound particles having thermal decomposition property (B) | | | Volume ratio of | Other blending components | |
|---|---|---|---|---|---|---|---|---|---|---|---|---|
| | | Material | Mixing ratio | Mw | Penetration | Blending amount (parts) | Name | Average particle size | Penetration | (A)/(B) | Name | Penetration |
| 1 | 21 | FRW/IPW | 40:60 | 600 | 15 | 100 | — | — | 0 | 100/0 | MSG | 0.64 |
| 2 | 22 | FRW/IPW | 40:60 | 600 | 15 | 32 | D-G | 15 | 38 | 45/55 | MSG | 0.25 |
| 3 | 23 | FRW/IPW | 20:80 | 500 | 35 | 75 | D-G | 15 | 25 | 84/16 | MSG | 0.25 |
| 4 | 24 | FRW/MCW | 95:5 | 880 | 1 | 75 | D-G | 15 | 25 | 84/16 | MSG | 0.25 |
| 5 | 25 | FRW/IPW | 40:60 | 600 | 15 | 75 | D-G | 25 | 25 | 84/16 | MSG | 0.25 |
| 6 | 26 | FRW/IPWW | 40:60 | 600 | 15 | 75 | D-G | 1 | 25 | 84/16 | MSG | 0.25 |

TABLE 3

| | | Protecting agent | Preparation conditions: Melting temperature | Die preheating temperature | Primary cooling temperature | Reheating temperature | Reheating holding time | Final cooling temperature | Endothermic peak temperature |
|---|---|---|---|---|---|---|---|---|---|
| Example | 1 | 1 | 160 | 110 | 40 | 45 | 15 | 25 | 45/105 |
| | 2 | 2 | 160 | 110 | 40 | 45 | 15 | 25 | 45/105 |
| | 3 | 3 | 160 | 110 | 40 | 45 | 15 | 25 | 45/105 |
| | 4 | 4 | 160 | 110 | 50 | 60 | 15 | 25 | 60/105 |
| | 5 | 5 | 160 | 110 | 40 | 45 | 15 | 25 | 45/105 |

TABLE 3-continued

| | | | Preparation conditions | | | | | | |
|---|---|---|---|---|---|---|---|---|---|
| | | Protecting agent | Melting temperature | Die preheating temperature | Primary cooling temperature | Reheating temperature | Reheating holding time | Final cooling temperature | Endothermic peak temperature |
| | 6 | 6 | 160 | 110 | 40 | 45 | 15 | 25 | 45/105 |
| | 7 | 7 | 150 | 110 | 40 | 45 | 15 | 25 | 45/102 |
| | 8 | 8 | 150 | 110 | 40 | 50 | 15 | 25 | 45/108 |
| | 9 | 9 | 160 | 110 | 40 | 45 | 15 | 25 | 45/105 |
| | 10 | 10 | 160 | 110 | 40 | 45 | 15 | 25 | 45/105 |
| | 11 | 11 | 160 | 110 | 40 | 45 | 15 | 25 | 45/105 |
| | 12 | 12 | 160 | 110 | 40 | 45 | 15 | 25 | 45/105 |
| | 13 | 13 | 160 | 110 | 40 | 45 | 15 | 25 | 45/105 |
| | 14 | 14 | 160 | 110 | 40 | 45 | 15 | 25 | 45/105 |
| | 15 | 15 | 160 | 120 | 40 | 50 | 15 | 25 | 50/115 |
| | 16 | 16 | 150 | 100 | 40 | 45 | 15 | 25 | 45/90 |
| | 17 | 17 | 160 | 125 | 45 | 50 | 15 | 25 | 50/118 |
| | 18 | 18 | 150 | 100 | 40 | 45 | 15 | 25 | 45/85 |
| | 19 | 19 | 160 | 110 | 45 | 50 | 15 | 25 | 50/105 |
| | 20 | 20 | 140 | 110 | 40 | 45 | 15 | 25 | 45/105 |
| Comparative example | 1 | 21 | 160 | 110 | 40 | 45 | 15 | 25 | 45/105 |
| | 2 | 22 | 160 | 110 | 40 | 45 | 15 | 25 | 45/105 |
| | 3 | 23 | 150 | 110 | 40 | 45 | 15 | 25 | 45/100 |
| | 4 | 24 | 160 | 110 | 40 | 45 | 15 | 25 | 107 |
| | 5 | 25 | 160 | 110 | 40 | 45 | 15 | 25 | 45/105 |
| | 6 | 26 | 160 | 110 | 40 | 45 | 15 | 25 | 45/105 |

Example 21

A process cartridge having the protecting-layer forming device using the protecting agent 1 according to the example 1 was prepared in the following manner. A transfer device, a counter-type cleaning blade, a brush-shaped protecting-agent supplying unit, a trailing-blade type protecting-layer forming unit are arranged in this order from the upstream side around an image carrier (photoconductor). More specifically, the image carrier has a surface layer of which surface contains thermosetting resin (thermal radical reaction type polyfunctional acrylic resin) and of which thickness is 5 micrometers.

The obtained process cartridge was set in an image forming apparatus (Color multifunction product (MFP): imagio Neo C600 manufactured by RICOH COMPANY, LTD) which was modified so that the process cartridge was able to be incorporated therein). A test on continuous printing of images was conducted by using the image forming apparatus in such a manner that an A4-size document having an image area ratio of 6% was continuously printed by 100,000 sheets. It was checked whether the images were normal before and after the test was conducted, in an environment with normal-temperature and normal-humidity conditions of 20° C. and 50% RH, an environment with low-temperature and low-humidity conditions of 10° C. and 25% RH, and an environment with high-temperature and high-humidity conditions of 35° C. and 80% RH.

At this time, toner manufactured by a polymerization method was used. More specifically, the toner had a weight-average particle size (D4)=5.2 micrometers, a number-average particle size (D1)=4.5 micrometers, D4/D1=1.16, and an average circularity=0.98.

Anomaly in images obtained after the continuous passing test includes a streak-like image defect, uneven half-tone image, background fogging, and image blur, which are related to whether the cleaning performance is excellent. These anomalies were evaluated based on the following evaluation criteria.

<Evaluation Criteria of Streak-like Image Defect>

◎: Extremely excellent
○: Satisfactory
Δ: Acceptable
x: Unusable

<Evaluation Criteria of Uneven Half-Tone Image>

◎: Extremely excellent
○: Satisfactory
Δ: Acceptable
x: Unusable

<Evaluation Criteria of Background Fogging>

◎: Extremely excellent
○: Satisfactory
Δ: Acceptable
x: Unusable

<Evaluation Criteria of Image Blur>

◎: Extremely excellent
○: Satisfactory
Δ: Acceptable
x: Unusable

It was visually observed whether any foreign matter was fixed to the surface of the protecting agent at the time of outputting 100,000 sheets, and evaluation was made based on the following evaluation criteria.

<Evaluation Criteria of State of Each Unit>

◎: Not fixed
○: Slightly fixed
Δ: Dotted (Usable)
x: Fixed in a wide range

Furthermore, to evaluate how respective degradations of the image carrier, the cleaning blade, and the charging unit affected images, each initial state of the respective units and each state at the time of outputting 100,000 sheets were observed. It was thereby checked whether any defect was found in each of the units, and evaluation was made based on the following evaluation criteria.

<Evaluation Criteria of State of Each Unit>

○: Equivalent to initial level
Δ: Slightly changed (Usable)
X: Degraded

As a result, no degradation with an increase in the number of printed sheets was found in all the units. Further, excellent image quality was obtained at the time of initial output and also after 100,000 sheets were output. No anomaly was found in the images after heat cycle. Thus, it is obvious that the image forming apparatus according to the present invention is effective in aspects of the image quality and its life.

Tables 4 and 5 are lists indicating evaluation results of the image quality. The table 4 indicates image quality in the initial state before the test on continuous printing of images was started, and the table 5 indicates image quality after 100,000 sheets were continuously output.

Table 6 is a list indicating each state of the units after the continuous outputting was performed.

Evaluation results of the image quality are shown in the table 4 and the table 5, while observation results on how the units were degraded are shown in the table 6.

Following the test on continuous printing of images, a "paper passing test" was conducted up to 500,000 sheets in total using the image forming apparatus according to the example 21. As a result, the images were not affected at all, and respective degradations of the image carrier, the cleaning unit, and the charging unit were hardly found.

Examples 22 to 40

The configuration according to the example 21 was not changed except for the protecting agents 2 to 20 used instead of the protecting agent 1, and evaluation was made in the same manner as that of the example 21.

The evaluation results of the image quality and results as to whether any foreign matter was fixed to the protecting agent are shown in the table 4 and the table 5, while the observation results on how the units were degraded are shown in the table 6.

It is noted that the paper passing test was conducted up to 500,000 sheets in total by using the image forming apparatuses according to examples 21, 22, and 23. As a result, the images were not affected at all, and respective degradations of the image carrier, the cleaning unit, and the charging unit were hardly found.

Comparative Examples 7 to 12

The configuration according to the example 21 was not changed except for the protecting agents 21 to 26 used instead of the protecting agent 1, and evaluation was made in the same manner as that of the example 21.

The evaluation results of the image quality and results as to whether any foreign matter was fixed to the protecting agent are shown in the table 4 and the table 5, while the observation results on how the units were degraded are shown in the table 6.

Example 41

A process cartridge having the protecting-layer forming device using the protecting agent 1 according to the example 1 was prepared in the following manner. A transfer device, a brush-shaped protecting-agent supplying unit, and a protecting-layer forming unit used also as a counter-type cleaning blade are arranged in this order from the upstream side around an image carrier. More specifically, the image carrier has a surface layer of which surface contains thermosetting resin (thermal radical reaction type polyfunctional acrylic resin) and of which thickness is 5 micrometers.

The obtained process cartridge was set in an image forming apparatus (Color MFP: imagio Neo C455 manufactured by RICOH COMPANY, LTD) which was modified so that the process cartridge was able to be incorporated therein). The test on continuous printing of images was conducted by using the image forming apparatus in such a manner that an A4-size document having an image area ratio of 6% was continuously printed by 100,000 sheets. It was checked whether the images were normal before and after the test was conducted.

At this time, toner manufactured by a polymerization method was used. More specifically, the toner had a weight-average particle size (D4)=5.2 micrometers, a number-average particle size (D1)=4.5 micrometers, D4/D1=1.16, and an average circularity=0.98.

Anomaly in images includes a streak-like image defect, uneven half-tone image, background fogging, and image blur, which are related to whether the cleaning performance is excellent. These anomalies were evaluated in the same manner as that of the example 21.

Furthermore, to evaluate how respective degradations of the image carrier, the cleaning blade, and the charging unit affected images, in the same manner as that of the example 21, each initial state of the respective units and each state at the time of outputting 100,000 sheets were observed. It was thereby checked whether any defect was found in the units.

The evaluation results of the image quality and results as to whether any foreign matter was fixed to the protecting agent are shown in the table 4 and the table 5, while the observation results on how the units were degraded are shown in the table 6.

Example 42

The configuration according to the example 21 was not changed except for an image carrier not containing thermosetting resin (thermal radical reaction type polyfunctional acrylic resin) in its surface layer to be used as the image carrier, and the test was conducted in the same manner as that of the example 21.

The evaluation results of the image quality and results as to whether any foreign matter was fixed to the protecting agent are shown in the table 4 and the table 5, while the observation results on how the units were degraded are shown in the table 6.

Example 43

The configuration according to the example 21 was not changed except for usage of toner manufactured by a polymerization method as follows, and the test was conducted in the same manner as that of the example 21. More specifically, the toner had a weight-average particle size (D4)=6.0 micrometers, a number-average particle size (D1)=5.3 micrometers, D4/D1=1.13, and an average circularity=0.90.

The evaluation results of the image quality and results as to whether any foreign matter was fixed to the protecting agent are shown in the table 4 and the table 5, while the observation results on how the units were degraded are shown in the table 6.

Example 44

The configuration according to the example 21 was not changed except for usage of toner manufactured by a polymerization method as follows, and the test was conducted in the same manner as that of the example 21. More specifically, the toner had a weight-average particle size (D4)=5.4 micrometers, a number-average particle size (D1)=3.5 micrometers, D4/D1=1.54, and an average circularity=0.98.

The evaluation results of the image quality and results as to whether any foreign matter was fixed to the protecting agent are shown in the table 4 and the table 5, while the observation results on how the units were degraded are shown in the table 6.

TABLE 4

| | | Image quality (Normal temperature and Normal humidity) | | | | Image quality (Low temperature and Low humidity) | | | | Image quality (High temperature and High humidity) | | | |
|---|---|---|---|---|---|---|---|---|---|---|---|---|---|
| | | Streak | Uneven image | Back-ground fogging | Image blur | Streak | Uneven image | Back-ground fogging | Image blur | Streak | Uneven image | Back-ground fogging | Image blur |
| Example | 21 | ◎ | ◎ | ◎ | ◎ | ◎ | ◎ | ◎ | ◎ | ◎ | ◎ | ◎ | ◎ |
| | 22 | ◎ | ◎ | ◎ | ◎ | ◎ | ◎ | ◎ | ◎ | ◎ | ◎ | ◎ | ◎ |
| | 23 | ◎ | ◎ | ◎ | ◎ | ◎ | ◎ | ◎ | ◎ | ◎ | ◎ | ◎ | ◎ |
| | 24 | ◎ | ◎ | ◎ | ◎ | ◎ | ◎ | ◎ | ◎ | ◎ | ◎ | ◎ | ◎ |
| | 25 | ◎ | ◎ | ◎ | ◎ | ◎ | ◎ | ◎ | ◎ | ◎ | ◎ | ◎ | ◎ |
| | 26 | ◎ | ◎ | ◎ | ◎ | ◎ | ◎ | ◎ | ◎ | ◎ | ◎ | ◎ | ◎ |
| | 27 | ◎ | ◎ | ◎ | ◎ | ◎ | ◎ | ◎ | ◎ | ◎ | ◎ | ◎ | ◎ |
| | 28 | ◎ | ◎ | ◎ | ◎ | ◎ | ◎ | ◎ | ◎ | ◎ | ◎ | ◎ | ◎ |
| | 29 | ◎ | ◎ | ◎ | ◎ | ◎ | ◎ | ◎ | ◎ | ◎ | ◎ | ◎ | ◎ |
| | 30 | ◎ | ◎ | ◎ | ◎ | ◎ | ◎ | ◎ | ◎ | ◎ | ◎ | ◎ | ◎ |
| | 31 | ◎ | ◎ | ○ | ◎ | ◎ | ○ | ◎ | ◎ | ◎ | ◎ | ○ | ◎ |
| | 32 | ◎ | ◎ | ◎ | ◎ | ◎ | ◎ | ◎ | ◎ | ◎ | ◎ | ◎ | ◎ |
| | 33 | ◎ | ◎ | ○ | ◎ | ◎ | ○ | ◎ | ◎ | ◎ | ◎ | ○ | ◎ |
| | 34 | ◎ | ◎ | ◎ | ◎ | ◎ | ◎ | ◎ | ◎ | ◎ | ◎ | ◎ | ◎ |
| | 35 | ◎ | ◎ | ◎ | ◎ | ◎ | ◎ | ◎ | ◎ | ◎ | ◎ | ◎ | ◎ |
| | 36 | ◎ | ◎ | ◎ | ◎ | ◎ | ◎ | ◎ | ◎ | ◎ | ◎ | ◎ | ◎ |
| | 37 | ◎ | ◎ | ◎ | ◎ | ◎ | ◎ | ◎ | ◎ | ◎ | ◎ | ◎ | ◎ |
| | 38 | ◎ | ◎ | ◎ | ◎ | ◎ | ◎ | ◎ | ◎ | ◎ | ◎ | ◎ | ◎ |
| | 39 | ◎ | ◎ | ◎ | ◎ | ◎ | ◎ | ◎ | ◎ | ◎ | ◎ | ◎ | ◎ |
| | 40 | ◎ | ◎ | ◎ | ◎ | ◎ | ◎ | ◎ | ◎ | ◎ | ◎ | ◎ | ◎ |
| | 41 | ◎ | ◎ | ◎ | ◎ | ◎ | ◎ | ◎ | ◎ | ◎ | ◎ | ◎ | ◎ |
| | 42 | ◎ | ◎ | ◎ | ◎ | ◎ | ◎ | ◎ | ◎ | ◎ | ◎ | ◎ | ◎ |
| | 43 | ◎ | ○ | ◎ | ◎ | ◎ | ◎ | ◎ | ◎ | ◎ | ○ | ◎ | ◎ |
| | 44 | ◎ | ◎ | ◎ | ◎ | ◎ | ◎ | ◎ | ◎ | ◎ | ◎ | ○ | ◎ |
| Comparative example | 7 | ◎ | ◎ | ◎ | ◎ | ◎ | ◎ | ◎ | ◎ | ◎ | ◎ | ◎ | ◎ |
| | 8 | ◎ | ◎ | ◎ | ◎ | ◎ | ◎ | ◎ | ◎ | ◎ | ○ | ◎ | ◎ |
| | 9 | ◎ | ◎ | ◎ | ◎ | ◎ | ◎ | ◎ | ◎ | ◎ | ◎ | ◎ | ◎ |
| | 10 | ◎ | ◎ | ◎ | ◎ | ◎ | ◎ | ◎ | ◎ | ◎ | ◎ | ◎ | ◎ |
| | 11 | ○ | ◎ | ◎ | ◎ | ○ | ◎ | ◎ | ◎ | ○ | ◎ | ◎ | ◎ |
| | 12 | ◎ | ◎ | ◎ | ◎ | ◎ | ◎ | ◎ | ◎ | ◎ | ◎ | ◎ | ◎ |

TABLE 5

| | | Image quality (Normal temperature and Normal humidity) | | | | Image quality (Low temperature and Low humidity) | | | | Image quality (High temperature and High humidity) | | | | |
|---|---|---|---|---|---|---|---|---|---|---|---|---|---|---|
| | | Streak | Uneven image | Back-ground fogging | Image blur | Streak | Uneven image | Back-ground fogging | Image blur | Streak | Uneven image | Back-ground fogging | Image blur | State of surface |
| Example | 21 | ◎ | ◎ | ◎ | ◎ | ◎ | ◎ | ◎ | ◎ | ◎ | ◎ | ◎ | ◎ | ◎ |
| | 22 | ◎ | ◎ | ◎ | ◎ | ◎ | ◎ | ◎ | ◎ | ◎ | ◎ | ◎ | ◎ | ◎ |
| | 23 | ◎ | ◎ | ◎ | ◎ | ◎ | ◎ | ◎ | ◎ | ◎ | ◎ | ◎ | ◎ | ◎ |
| | 24 | ◎ | ◎ | ◎ | ◎ | ◎ | ◎ | ◎ | ◎ | ◎ | ◎ | ◎ | ◎ | ◎ |
| | 25 | ◎ | ◎ | ◎ | ◎ | ○ | ◎ | ◎ | ◎ | ◎ | ◎ | ○ | ○ | ○ |
| | 26 | ○ | ○ | ◎ | ◎ | ○ | ○ | ◎ | ◎ | ◎ | ○ | ◎ | ○ | ◎ |
| | 27 | ◎ | ◎ | ◎ | ◎ | ○ | ◎ | ◎ | ◎ | ◎ | ◎ | ○ | ○ | ○ |
| | 28 | ○ | ◎ | ◎ | ◎ | ○ | ◎ | ○ | ◎ | ○ | ○ | ◎ | ◎ | ◎ |
| | 29 | ○ | ◎ | ◎ | ◎ | ○ | ◎ | ◎ | ◎ | ○ | ◎ | ◎ | ◎ | ◎ |
| | 30 | ◎ | ◎ | ◎ | ◎ | ○ | ◎ | ◎ | ◎ | ◎ | ◎ | ○ | ○ | ○ |
| | 31 | ◎ | ◎ | ○ | ◎ | ◎ | ○ | ◎ | ◎ | ◎ | ◎ | ○ | ○ | ○ |
| | 32 | ◎ | ◎ | ◎ | ◎ | ○ | ◎ | ◎ | ◎ | ◎ | ◎ | ◎ | ◎ | ◎ |
| | 33 | ◎ | ◎ | Δ | ○ | ◎ | Δ | ◎ | ◎ | ◎ | ○ | Δ | Δ | Δ |
| | 34 | ○ | ○ | ◎ | ◎ | Δ | ○ | ◎ | ◎ | ◎ | ◎ | ◎ | ◎ | ◎ |
| | 35 | ◎ | ◎ | ◎ | ◎ | ○ | ◎ | ○ | ◎ | ◎ | ○ | ◎ | ◎ | ◎ |
| | 36 | ◎ | ◎ | ◎ | ◎ | ○ | ◎ | ◎ | ◎ | ◎ | ◎ | ○ | ○ | ○ |
| | 37 | ◎ | ○ | ◎ | ◎ | Δ | ◎ | ◎ | ◎ | ○ | Δ | ◎ | ◎ | ◎ |
| | 38 | ◎ | ◎ | ○ | ○ | ◎ | ○ | ◎ | ◎ | ◎ | ○ | Δ | Δ | Δ |
| | 39 | ○ | ○ | ◎ | ◎ | Δ | ◎ | ◎ | ◎ | ○ | Δ | ◎ | ◎ | ◎ |
| | 40 | ◎ | ○ | ○ | ◎ | ○ | ○ | ○ | ◎ | ◎ | ○ | ○ | ○ | ◎ |
| | 41 | ◎ | ◎ | ◎ | ◎ | ○ | ◎ | ○ | ◎ | ◎ | ◎ | ◎ | ○ | ○ |
| | 42 | ○ | ○ | ◎ | ◎ | ◎ | ◎ | ◎ | ◎ | ◎ | ◎ | ◎ | ◎ | ◎ |
| | 43 | ◎ | Δ | ◎ | ◎ | ◎ | ◎ | ○ | ◎ | ◎ | Δ | ◎ | ◎ | ◎ |
| | 44 | ◎ | ○ | ○ | ◎ | ◎ | ○ | ◎ | ◎ | ◎ | ◎ | Δ | ◎ | ○ |

TABLE 5-continued

| | | Image quality (Normal temperature and Normal humidity) | | | | Image quality (Low temperature and Low humidity) | | | | Image quality (High temperature and High humidity) | | | | |
|---|---|---|---|---|---|---|---|---|---|---|---|---|---|---|
| | | Streak | Uneven image | Back-ground fogging | Image blur | Streak | Uneven image | Back-ground fogging | Image blur | Streak | Uneven image | Back-ground fogging | Image blur | State of surface |
| Comparative example | 7 | Δ | Δ | Δ | Δ | X | Δ | Δ | Δ | Δ | Δ | X | X | X |
| | 8 | X | X | Δ | Δ | X | X | Δ | Δ | Δ | X | Δ | X | ○ |
| | 9 | Δ | Δ | Δ | Δ | X | Δ | Δ | Δ | Δ | Δ | X | X | X |
| | 10 | X | Δ | Δ | ◎ | X | Δ | X | ◎ | X | X | ○ | ◎ | ◎ |
| | 11 | X | Δ | Δ | ◎ | X | Δ | Δ | ◎ | X | Δ | Δ | ◎ | ○ |
| | 12 | Δ | Δ | Δ | Δ | X | Δ | Δ | Δ | Δ | Δ | X | X | X |

TABLE 6

| | | Image carrier | Cleaning unit | Charging unit |
|---|---|---|---|---|
| Example | 21 | ○ | ○ | ○ |
| | 22 | ○ | ○ | ○ |
| | 23 | ○ | ○ | ○ |
| | 24 | ○ | ○ | ○ |
| | 25 | Δ | ○ | ○ |
| | 26 | Δ | ○ | ○ |
| | 27 | Δ | ○ | ○ |
| | 28 | Δ | Δ | ○ |
| | 29 | Δ | Δ | Δ |
| | 30 | Δ | ○ | ○ |
| | 31 | Δ | ○ | ○ |
| | 32 | ○ | ○ | Δ |
| | 33 | Δ | ○ | ○ |
| | 34 | ○ | ○ | Δ |
| | 35 | Δ | ○ | ○ |
| | 36 | Δ | ○ | ○ |
| | 37 | Δ | Δ | ○ |
| | 38 | Δ | ○ | ○ |
| | 39 | Δ | ○ | Δ |
| | 40 | Δ | ○ | Δ |
| | 41 | Δ | Δ | ○ |
| | 42 | Δ | ○ | ○ |
| | 43 | Δ | ○ | ○ |
| | 44 | Δ | ○ | Δ |
| Comparative example | 7 | X | Δ | Δ |
| | 8 | X | Δ | Δ |
| | 9 | X | ○ | X |
| | 10 | X | X | Δ |
| | 11 | X | X | X |
| | 12 | X | Δ | Δ |

From the results of the table 1 to the table 6, in the examples 21 to 44 in which the protecting agent according to the present invention was used, it is confirmed that the image quality related to streak, uneven image, background fogging, and image blur is more satisfactory as compared with that in the comparative examples 7 to 12. It is also confirmed that each degradation of the image carrier, the cleaning unit, and the charging unit due to the increase of printed sheets was extremely low as compared with that in the comparative examples 7 to 12.

The example 21 (protecting agent 1) is compared with each of the example 31 (protecting agent 11) to the example 34 (protecting agent 14) whose contents of the amphiphilic organic compound are different from the content in the example 21. According to the comparison, the performance as the protecting agent gradually decreases as the content of the amphiphilic organic compound falls outside a predetermined range. When the content exceeds 5 wt % of the organic compound particles having thermal decomposition property, the affinity between the particles and the organic compound having melting property becomes too high, which causes fixing of foreign matters to the surface of the protecting agent to slightly easily occur. Therefore, it is found that the performance is degraded in terms of the image quality in association with the occurrence. Conversely, when the content is below 0.1 wt % of the organic compound particles having thermal decomposition property, the particles are not sufficiently dispersed, and thus, it is found that a streak-like image defect tends to degrade in the low-humidity environment.

The example 21 (protecting agent 1) is compared with each of the example 35 (protecting agent 15) to the example 38 (protecting agent 18) whose average molecular weights of the organic compound having melting property are different from that in the example 21. According to the comparison, the performance as the protecting agent gradually decreases as the average molecular weight of the organic compound having melting property falls outside a predetermined range. When the average molecular weight increases, the protecting performance of the protecting agent gradually decreases, and thus, it is found that the performance is degraded in terms of the image quality. Conversely, when the average molecular weight decreases, the effect of the organic compound particles having thermal decomposition property is difficult to be expressed, which causes fixing of foreign matters to the surface of the protecting agent to slightly easily occur. Therefore, it is found that the performance is degraded in terms of the image quality in association with the occurrence.

The example 21 (protecting agent 1) is compared with each of the example 24 (protecting agent 4) and the example 39 (protecting agent 19) whose organic compounds having melting property are different from that in the example 21. According to the comparison, when the organic compound having melting property contains neither isoparaffin nor cycloparaffin, the protecting performance of the protecting agent decreases. Therefore, it is found that the performance is degraded in terms of the image quality, particularly the image quality depending on changes in the environment.

The example 21 (protecting agent 1) to the example 23 (protecting agent 3) are compared with the example 40 (protecting agent 20), in which organic compound particles having thermal decomposition property are different from each other. According to the comparison, when the organic compound particles having thermal decomposition property are other than a specific compound, the protecting performance of the protecting agent in the example 40 is slightly inferior. Therefore, it is found that there is a difference in the performances in terms of the image quality.

On the other hand, in the comparative examples 7 to 12 in which the protecting agents 21 to 26 that do not satisfy the requirements of the present invention are used as the protecting agent, the prevention of fixing of foreign matters to the surface of the protecting agent and the protection of the image carrier cannot be compatible. Thus, the effect of protection of the image carrier while maintaining the image quality cannot be expressed.

As is clear from the examples, the protecting agent for the image carrier and the protecting-layer forming device according to the present invention protect the image carrier from the electrical stress due to charging or the like and the mechanical stress due to a slidable contact of the cleaning unit against the image carrier. And the protecting agent degraded caused by the electrical stress hardly affects the quality of images and the peripheral units. Thus, the protecting agent and the protecting-layer forming device are appropriately used in the electrophotographic image forming method, the image forming apparatus, and the process cartridge.

The configuration and the effects of the present invention are summed up below.

The protecting agent for the image carrier according to the present invention contains at least the organic compounds having melting property of which penetration at 25° C. ranges from 3 millimeters to 30 millimeters and the organic compound particles having thermal decomposition property of which a weight average particle size D4 ranges from 2 micrometers to 20 micrometers. The melting temperature of the organic compound having melting property is lower than the decomposition temperature of the organic compound particles having thermal decomposition property, and the volume ratio of the organic compound having melting property to the organic compound particles having thermal decomposition property ranges from 99/1 to 50/50.

The protecting agent for the image carrier according to the present invention is deposited on the surface of the image carrier during the protecting-layer forming process of the image forming process in the image forming apparatus. And the protecting agent coats the surface of the image carrier upon the deposition or after the deposition to form a uniform protecting layer. If the coating is not adequate, the surface of the image carrier cannot be protected from the electrical stress in the subsequently performed charging process.

To form the coating adequately, the protecting agent deposited on the image carrier is slid by a sliding unit such as the brush or the blade to simply deform the composition. However, if the extensibility of the protecting agent is not enough, it is necessary to apply a large force to form the coating, which results in application of large mechanical stress also to the image carrier. If the protecting agent has satisfactory extensibility even at normal temperature, the uniform protecting layer can be formed with comparatively weak force. The organic compound having melting property of which penetration at 25° C. ranges from 3 millimeters to 30 millimeters is used for the composition of the protecting agent, which allows formation of satisfactory protecting layer.

However, satisfactory extensibility often causes the protecting agent to easily soften, which may cause foreign matters such as residual toner to adhere to or be buried in the surface of the protecting agent which is a supply source. Because of this, the supply amount of the protecting agent may vary with time or the supply may be failed.

To effectively prevent adhesion of these foreign matters thereto, if the adhesion of the protecting agent to the foreign matters is reduced or even if the foreign matters adhere to the surface thereof, particle components are also used by being simply dispersed into an organic compound having melting property so that the protecting agent may come off the internal interface near the surface of the protecting agent by a suitable size through slidable contact of the protecting-agent supplying unit against the surface of the image carrier. By using the organic compound particles having thermal decomposition property of which weight average particle size is 2 micrometers to 20 micrometers as the shared particle components, the protecting agent is decomposed in the subsequently performed charging process for a comparatively short period, to be low-molecular weight components. Thus, the degraded components of the particles will not remain on the surface of the image carrier and on the charging unit over a long period of time. Accordingly, the image forming apparatus including the image carrier can be continuously maintained at the excellent state over a long period of time.

Furthermore, when a blending amount of the organic compound having melting property is high and the volume ratio thereof to the organic compound particles exceeds 99/1, the internal interface of the protecting agent is not satisfactorily formed, which cannot sufficiently suppress the deposition of the foreign matters on the surface of the protecting agent.

Conversely, when the blending amount of the organic compound having melting property is low and the volume ratio thereof to the organic compound particles is below 50/50, the organic compound components having melting property to be supplied to the surface of the image carrier become insufficient, which causes the protecting layer to be nonuniform, and thus it is difficult to protect the surface of the image carrier from the electrical stress.

The protecting-layer forming device according to the present invention includes the image carrier, the protecting-agent supplying unit that supplies the protecting agent to the surface of the image carrier, and the pressing-force imparting unit that pressing the protecting agent against the protecting-agent supplying unit. The protecting agents according to the present invention are often comparatively soft and easily deformed. Therefore, when the lump-shaped protecting agent is pressed onto the surface of the image carrier to form the protecting layer, the protecting agent is supplied too much. The protecting layer is thereby not efficiently formed, and is also multi-layered, which becomes a factor to block transmission of light in the exposure process upon formation of an electrostatic latent image. The factor causes usable types of the protecting agent to be limited. On the other hand, the protecting-layer forming device is configured in the above manner to interpose the supply unit between the protecting agent and the image carrier. Thus even when a soft protecting agent is used, the protecting agent can be evenly supplied to the surface of the image carrier.

The image forming apparatus according to the present invention includes the protecting-layer forming device according to the present invention having the protecting agent, and thus the image carrier can be continuously used without its replacement over a long period of time. Especially, when the image carrier contains the thermosetting resin in its outermost surface layer, the protecting agent prevents degradation of the image carrier due to the electrical stress, which makes it possible to continuously express the durability of the image carrier containing the thermosetting resin against the mechanical stress over a long period of time. Accordingly, the durability of the image carrier can be increased to the level at which the image carrier can be used substantially with no replacement thereof.

Furthermore, when the charger is arranged in contact with or close to the surface of the image carrier, the electrical discharge area is extremely close to the image carrier, and thus the electrical stress tends to increase. However, the image forming apparatus according to the present invention that includes the image carrier with the protecting layer formed thereon can be used without exposing the image carrier to the electrical stress.

Moreover, the protecting components for the image carrier according to the present invention do not substantially contain a metal component. Therefore, the charger arranged in contact with or close to the image carrier is not contaminated by metal oxide and the like, which also allows improvement of the durability of the charger.

The surface of the image carrier is covered with the protecting layer, and thus the change of the surface state can be extremely small. Therefore, even if toner particles have a large average circularity or have a small average particle size such that the state of the image carrier sensitively changes depending on whether the toner particles are satisfactorily cleaned, the cleaning can be stably performed over a long period of time.

The process cartridge according to the present invention includes the protecting-layer forming device having the protecting agent for the image carrier. Therefore, the replacement interval of the process cartridge can be set to extremely long, which allows reduction of the running costs and also large reduction in the amount of waste. Especially, when the image carrier contains the thermosetting resin in the outermost surface layer, the protecting agent prevents degradation of the image carrier due to the electrical stress, which makes it possible to continuously express the durability of the image carrier containing the thermosetting resin against the mechanical stress over a long period of time.

Moreover, the protecting agent for the image carrier according to the present invention does not substantially contain a metal component. Therefore, the charging unit arranged in contact with or close to the image carrier is not contaminated by metal oxide and the like, which allows reduction of deterioration with age of the charger. Accordingly, the components of the process cartridge such as the image carrier and the charging unit can easily be reused and the waste can further be reduced.

As described above, according to one aspect of the present invention, the conventional problems can be resolved, and the comparatively soft protecting agent for the image carrier can be stably supplied to the image carrier. Because of these features, it is possible to provide the protecting agent for the image carrier that can protect the image carrier from the electrical stress due to charging and from the mechanical stress due to a slidable contact of the cleaning unit against the image carrier, and provide the protecting-layer forming device using the protecting agent. It is also possible to provide the image forming method, the image forming apparatus, and the process cartridge capable of stably obtaining excellent image quality using these components.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A protecting agent for an image carrier, the protecting agent containing at least an organic compound having melting property of which penetration at 25° C. is in a range from 3 millimeters to 30 millimeters and an organic compound particle having thermal decomposition property of which a weight average particle size is in a range from 2 micrometers to 20 micrometers, wherein a melting temperature of the organic compound is lower than a decomposition temperature of the organic compound particle, and a volume ratio of the organic compound to the organic compound particle is in a range from 99/1 to 50/50.

2. The protecting agent according to claim 1, wherein the organic compound is hydrocarbon wax containing at least one of isoparaffin and cycloparaffin.

3. The protecting agent according to claim 1, wherein a weight-average molecular weight of the organic compound is in a range from 350 to 850.

4. The protecting agent according to claim 1, wherein the organic compound particle includes a polysaccharide in which an average monosaccharide of 5 to 100 is dehydrated and condensed.

5. The protecting agent according to claim 1, wherein the organic compound particle includes a thermosetting resin particle.

6. The protecting agent according to claim 1, wherein the organic compound particle includes a silicone rubber particle.

7. The protecting agent according to claim 1, further containing an amphiphilic organic compound of 0.1 weight percent to 5 weight percent with respect to the organic compound particle.

8. A protecting-layer forming device comprising:

a protecting agent for an image carrier, the protecting agent containing at least an organic compound having melting property of which penetration at 25° C. is in a range from 3 millimeters to 30 millimeters and an organic compound particle having thermal decomposition property of which a weight average particle size is in a range from 2 micrometers to 20 micrometers;

a holding unit for holding the protecting agent;

a protecting-agent supplying unit that supplies the protecting agent to the image carrier; and a pressing-force applying unit that presses the protecting agent against the protecting-agent supplying unit to make the protecting agent in contact with the protecting-agent supplying unit, wherein a melting temperature of the organic compound is lower than a decomposition temperature of the organic compound particle, and a volume ratio of the organic compound to the organic compound particle is in a range from 99/1 to 50/50.

9. The protecting-layer forming device according to claim 8, further comprising a protecting-layer forming unit that forms a protecting layer with the protecting agent supplied to the image carrier.

10. An image forming apparatus comprising:

an image carrier on which an electrostatic latent image is formed;

an electrostatic-latent-image forming unit that forms the electrostatic latent image on the image carrier;

a developing unit that develops the electrostatic latent image using a toner to form a visible image;

a transfer unit that transfers the visible image onto a recording medium;

a protecting-layer forming device including a protecting agent for an image carrier, the protecting agent containing at least an organic compound having melting property of which penetration at 25° C. is in a range from 3 millimeters to 30 millimeters and an organic compound particle having thermal decomposition property of which a weight average particle size is in a range from 2 micrometers to 20 micrometers, a holding unit for holding the protecting agent, a protecting-agent supplying unit that supplies the protecting agent to the image carrier, and a pressing-force applying unit that presses the protecting agent against the protecting-agent supplying unit to make the protecting agent in contact with the protecting-agent supplying unit; and a fixing unit that fixes the visible image transferred onto the recording medium, wherein a melting temperature of the organic compound is lower than a decomposition temperature of the organic compound particle, and a volume ratio of the organic compound to the organic compound particle is in a range from 99/1 to 50/50.

11. The image forming apparatus according to claim 10, further comprising a cleaning unit provided on a downstream side of the transfer unit and an upstream side of the protecting-layer forming device in a direction of movement of the image carrier, and that removes a toner remaining on a surface of the image carrier.

12. The image forming apparatus according to claim 10, wherein the image carrier contains at least thermosetting resin in its outermost surface layer.

13. The image forming apparatus according to claim 10, wherein the image carrier is either one of a photosensitive element and an intermediate transfer element.

14. The image forming apparatus according to claim 10, wherein the electrostatic-latent-image forming unit includes a charging unit provided in contact with or close to a surface of the image carrier.

15. The image forming apparatus according to claim 14, wherein the charging unit includes a voltage applying unit that applies a voltage having an alternating current component.

16. The image forming apparatus according to claim 10, wherein the toner used in the developing unit has an average circularity of 0.93 to 1.00, which is an average of a circularity SR defined by circularity SR=(circumferential length of a circle having an area equivalent to a projected area of a toner particle)/(circumferential length of a projected image of the toner particle).

17. The image forming apparatus according to claim 10, wherein a ratio of a weight-average particle size to a number-average particle size of the toner is in a range from 1.00 to 1.40.

* * * * *